United States Patent [19]

Kozuka

[11] Patent Number: 4,792,824

[45] Date of Patent: Dec. 20, 1988

[54] ELECTROSTATIC COPYING APPARATUS HAVING REDUCED SIZE AND COMPLEXITY

[75] Inventor: Nobuhiko Kozuka, Suita, Japan

[73] Assignee: Mita Industrial Co., Ltd., Osaka, Japan

[21] Appl. No.: 920,535

[22] Filed: Oct. 20, 1986

[30] Foreign Application Priority Data

Nov. 6, 1985 [JP] Japan ..... 60-247204

[51] Int. Cl.[4] ..... G03G 15/00

[52] U.S. Cl. ..... 355/3 BE; 355/14 CH; 355/14 SH; 355/14 TR; 355/15

[58] Field of Search ..... 355/3 BE, 15, 3 CH, 355/3 TR, 3 SH, 14 CH, 14 SH, 14 TR

[56] References Cited

U.S. PATENT DOCUMENTS

| | | | |
|---|---|---|---|
| 3,647,293 | 3/1972 | Queener | 355/15 |
| 4,236,807 | 12/1980 | Kuehnle | 355/3 R |
| 4,257,700 | 3/1981 | Tsuda et al. | 355/3 TR |
| 4,330,198 | 5/1982 | Matsumoto et al. | 355/14 D |
| 4,372,669 | 2/1983 | Fantuzzo et al. | 355/3 CH |
| 4,403,851 | 9/1983 | Yanagawa | 355/3 BE |
| 4,432,632 | 2/1984 | Yokota | 355/3 BE |
| 4,470,693 | 9/1984 | Dolan | 355/3 TR |
| 4,488,802 | 12/1984 | Sunaga et al. | 355/3 CH |
| 4,508,334 | 4/1985 | Iwanaga | 355/3 BE |
| 4,531,823 | 7/1985 | Deguchi et al. | 355/3 R |
| 4,536,075 | 8/1985 | Hoffman | 355/14 D |
| 4,563,076 | 1/1986 | Takahoshi et al. | 355/3 CH |
| 4,579,440 | 4/1986 | Katoh | 355/3 CH |
| 4,610,529 | 9/1986 | Koizumi | 355/3 SH |
| 4,647,177 | 3/1987 | Yoshihito et al. | 355/3 CH |
| 4,657,369 | 4/1987 | Takeuchi | 355/3 BE |
| 4,668,072 | 5/1987 | Yasuda | 355/3 BE |

FOREIGN PATENT DOCUMENTS

| | | |
|---|---|---|
| 139448 | 2/1985 | European Pat. Off. . |
| 3527159 | 6/1986 | Fed. Rep. of Germany . |

OTHER PUBLICATIONS

Patent Abstracts of Japan vol. 9 No. 273 (P-401) [1996], Oct. 30th, 1985; & JP-A-60 118 860 (MITA KOGYO) 26-06-1985.

*Primary Examiner*—Patrick R. Salce
*Assistant Examiner*—Jeffrey Sterrett
*Attorney, Agent, or Firm*—Beveridge, DeGrandi & Weilacher

[57] ABSTRACT

An electrostatic copying apparatus including a photosensitive material-supporting means having a photosensitive material on at least a part of its surface and an image forming means for forming an image on the surface of the photosensitive material. According to a first of the invention, the length of the photosensitive material in the moving direction is substantially equal to, or larger than, the maximum copyable length, and the photosensitive material-supporting means is moved in a predetermined direction during image formation and in a direction opposite to the predetermined direction during image transfer. According to other aspects of the invention, various improvements are achieved in relation to: a member having a slit opening for regulating light from an illuminating lamp, to a supporting structure on which to mount the photosensitive material-supporting means, a charging corona discharger, an optical system and a developing device, to the developing device mounted on the supporting structure, to a hand-inserting paper feed table for supplying a copying paper to a paper conveying passage, to a paper receiver for receiving copies, and also to a mechanism for peeling copying paper kept in intimate contact with the surface of the photosensitive material.

24 Claims, 13 Drawing Sheets

14
152
8
74
12
10
84
2
146
145
252
250
72
186
208
266
188
P

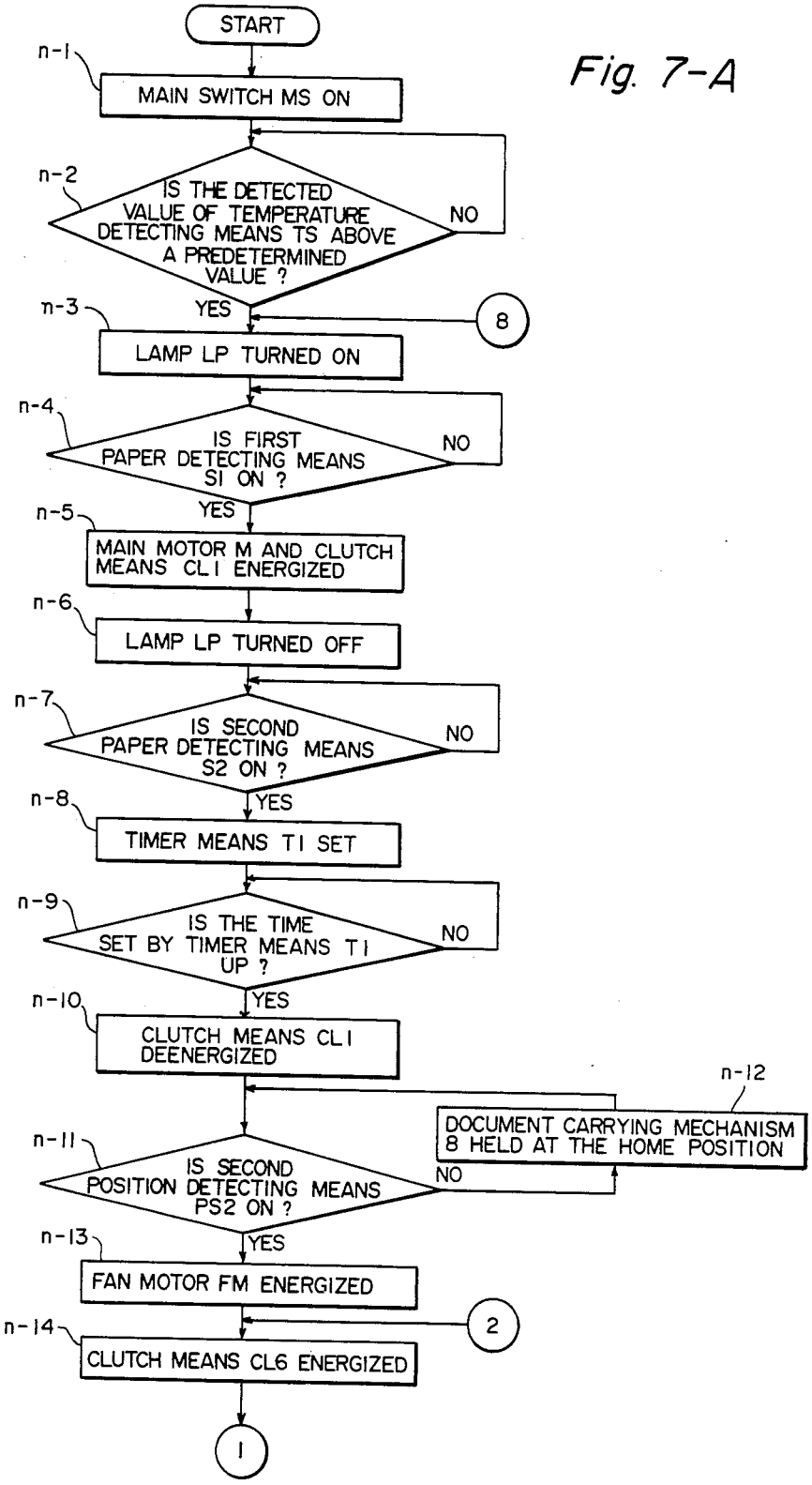
Fig. 7-A

Fig. 7-B
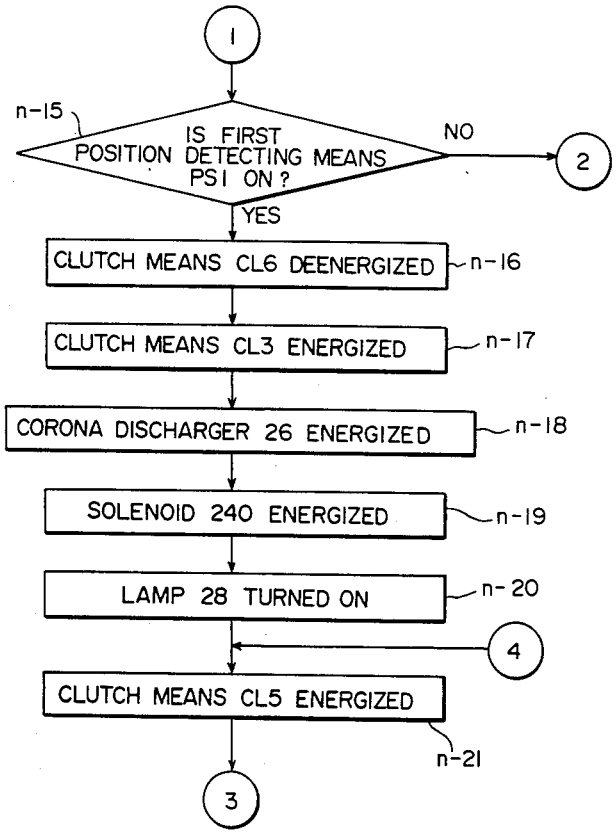

Fig. 7-C
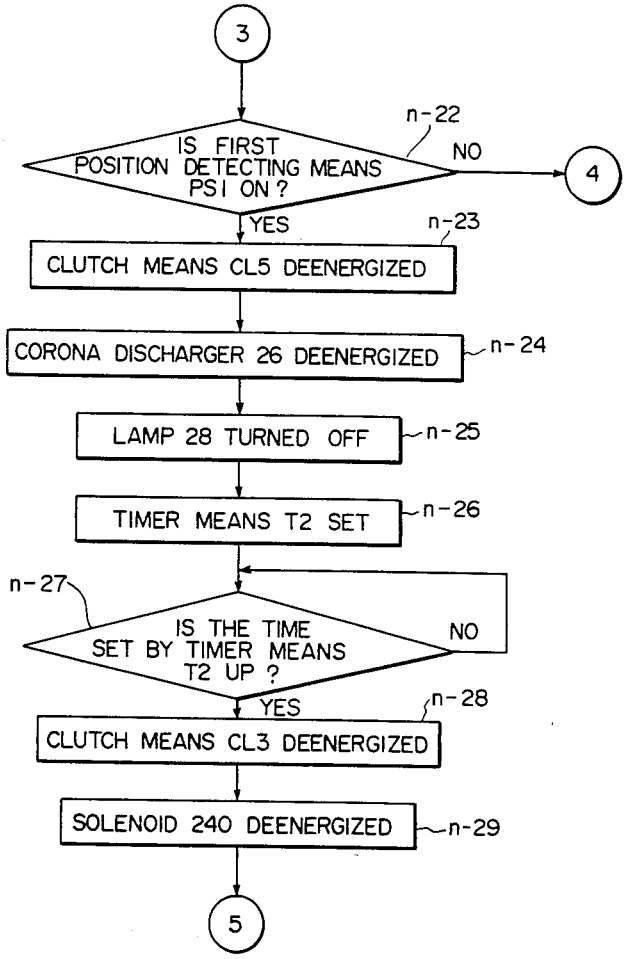

Fig. 7-D
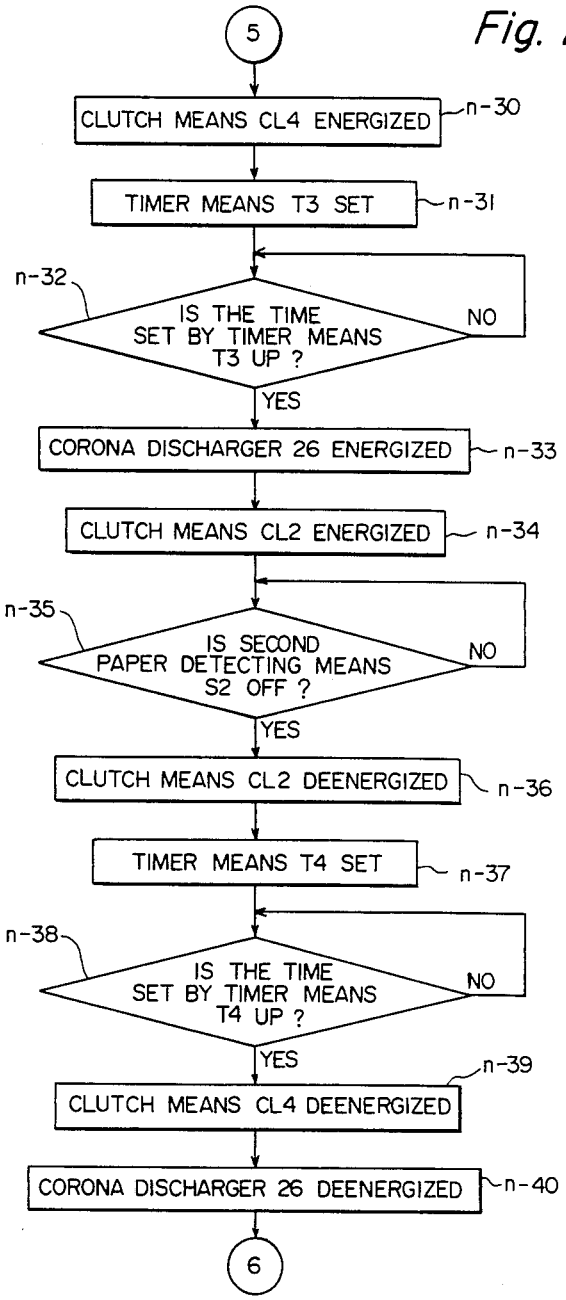

Fig. 7-E
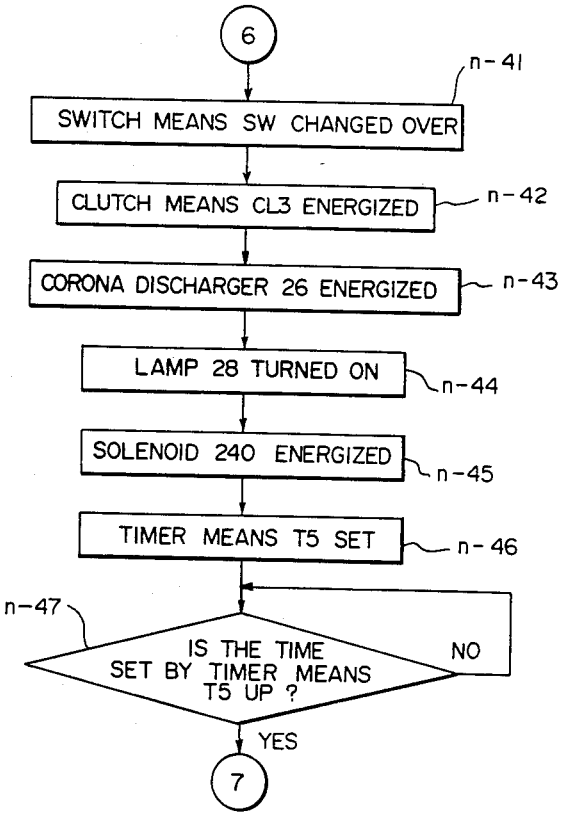

Fig. 7-F
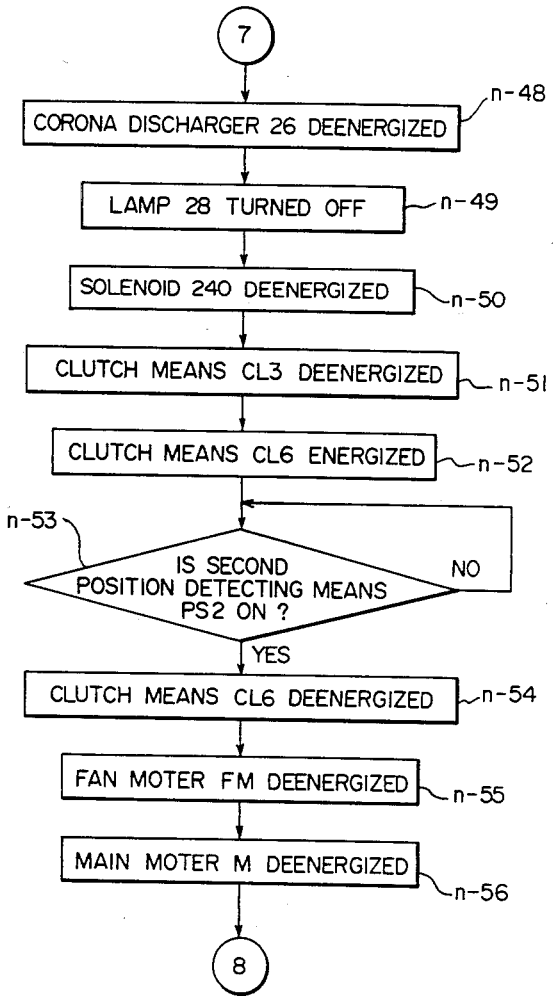

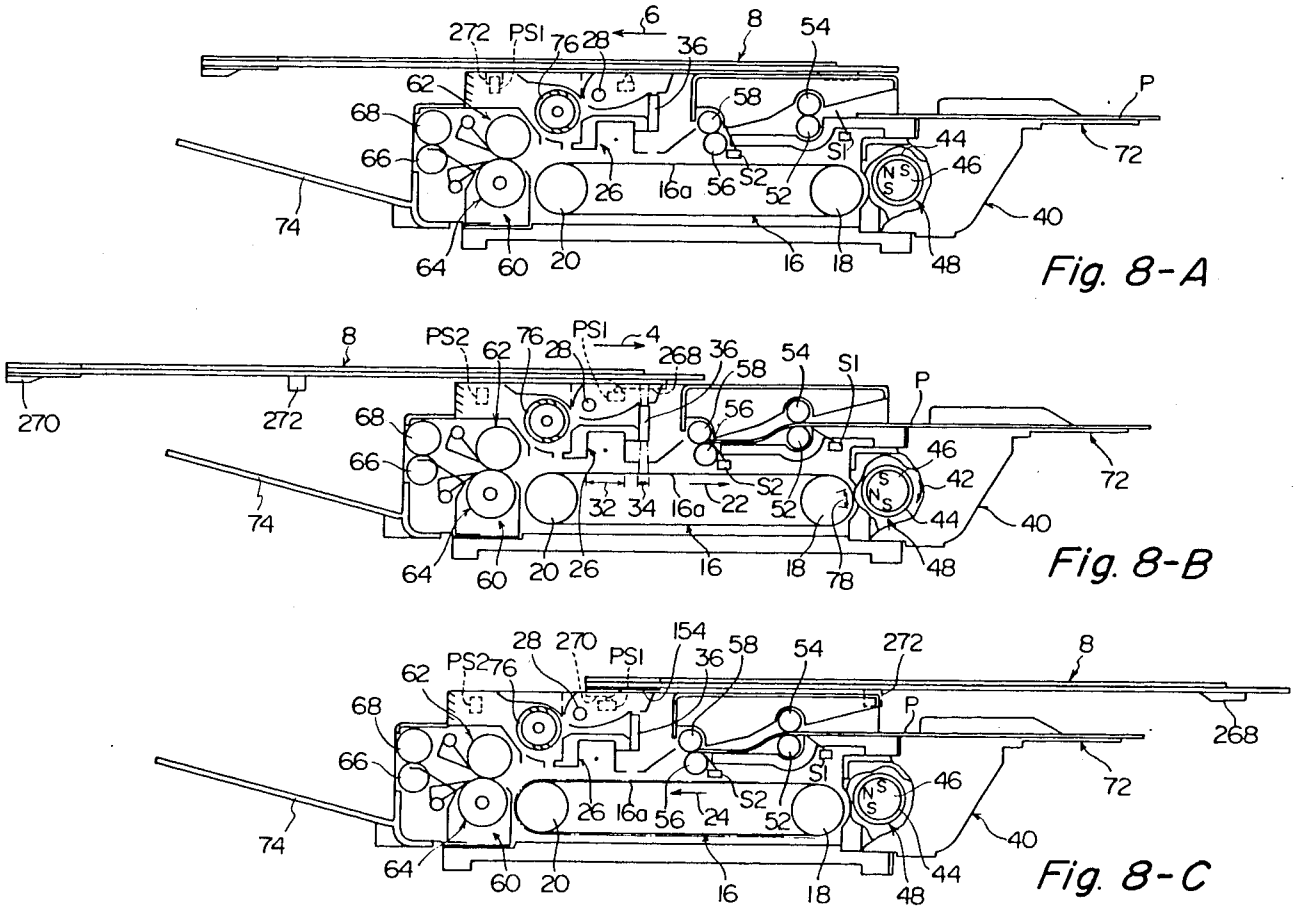
Fig. 8-A
Fig. 8-B
Fig. 8-C

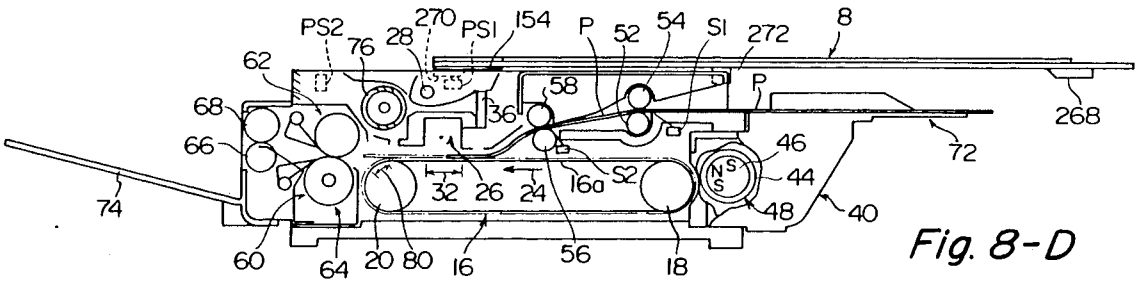
Fig. 8-D
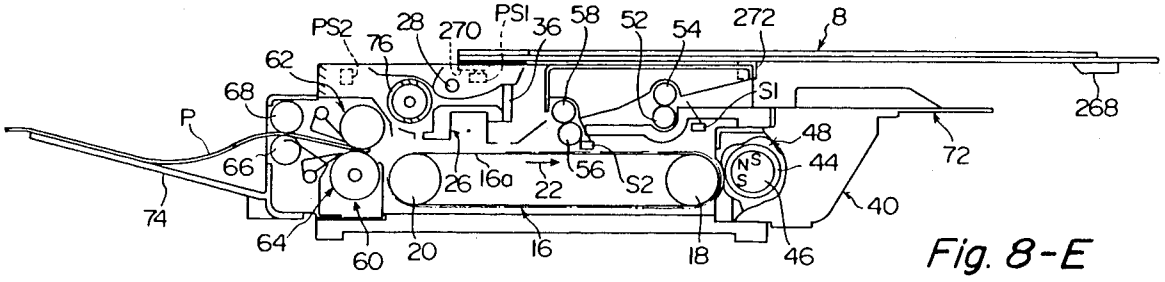
Fig. 8-E
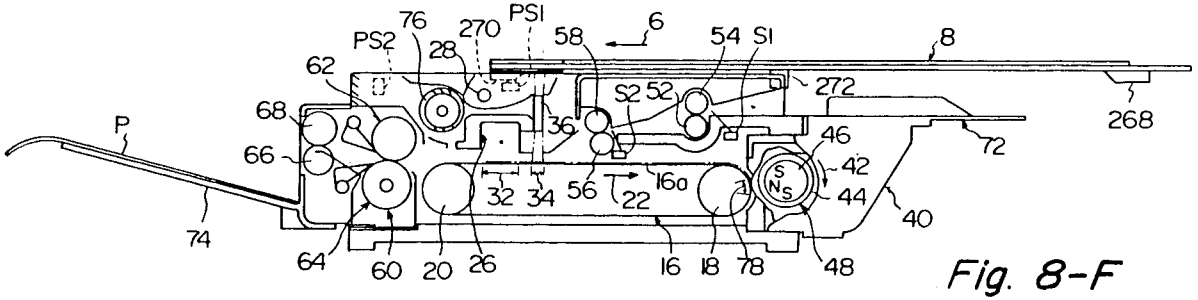
Fig. 8-F

ELECTROSTATIC COPYING APPARATUS HAVING REDUCED SIZE AND COMPLEXITY

BACKGROUND OF THE INVENTION

1. Field of the Invention

This invention relates to some improvements in an electrostatic copying apparatus.

2. Description of the Prior Art

Generally, the electrostatic copyigg apparatus has a photosensitive material-supporting means such as a rotating drum on the surface of which a photosensitive material is disposed, and around the photosensitive material-supporting means are provided a charging corona discharger corresponding to a charging zone, an illuminating lamp and an optical system in relation to an exposing zone, a developing device in relation to a development zone, a transfer corona discharger in relation to a transfer zone, and a cleaning device in relation to a cleaning zone. The supporting means is moved in a predetermined direction, and a copying process or cycle is performed as follows according to the movement of the supporting means. In the charging zone, a charge of a specified polarity is imparted to the surface of the photosensitive material on the supporting means by the action of the charging corona discharger, and then in the exposing zone, light (light reflected from a document) from the illuminating lamp is projected onto the surface of the photosensitive material via the optical system to form a latent electrostatic image corresponding to the document on the photosensitive material. In the development zone, toner particles in the developing device are applied to the surface of the photosensitive material to develop the latent electrostatic image formed on the photosensitive material to a toner image. In the transfer zone, the toner image on the photosensitive material is transferred by the action of the transfer corona discharger to a copying paper sheet conveyed through a paper conveying passage. In the cleaning zone, the toner particles remaining on the surface of the photosensitive material after transfer are removed by the action of the cleaning device.

However, in the conventional electrostatic copying apparatus, the photosensitive material-supporting means is moved always in a predetermined direction. The aforesaid elements (such as the charging corona discharger) must be disposed around the supporting means corresponding to the individual zones. This makes the apparatus complex and large-sized.

Furthermore, in order to make the conventional electrostatic copying apparatus simple in structure and small in size, various points to be improved exist with regard to (1) a slit member having a slit opening for regulating light projected from the illuminating lamp, (2) a supporting structure on which to mount the photosensitive material-supporting means, the charging corona discharger, the optical system, the development device, etc., (3) the developing device to be mounted on the supporting structure, (4) a paper feed table for hand insertion provided for feeding a copying paper sheet to a copying paper conveying passage, (5) a paper receiver for receiving copies, and (6) a mechanism for peeling a copying paper adhering intimately to the surface of the photosensitive material.

SUMMARY OF THE INVENTION

A first object of this invention is to provide an improved electrostatic copying apparatus suitable for making the structure of the apparatus as a whole simple and small-sized.

A second object of this invention is to provide an improved electrostatic copying apparatus in which light projected from an illuminating lamp can be regulated in a required manner without providing a slit member for exclusive use.

A third object of this invention is to provide an improved electrostatic copying apparatus which can be assembled by a simple assembling operation and can be made at a reduced cost.

A fourth object of this invention is to provide an improved electrostatic copying apparatus whose structure can be simplified with less component parts exterior of the apparatus.

A fifth object of this invention is to provide an improved electrostatic copying apparatus which can be made compact in relation to a hand-insertion paper feed table.

A sixth object of this invention is to provide an improved electrostatic copying apparatus whose structure can be simplified with less component parts in relation to the neighborhood of the downstream end portion of a copying paper conveying passage.

A seventh object of this invention is to provide an improved electrostatic copying apparatus in which a copying paper sheet can be peeled in a required manner from the surface of a photosensitive material without the need for providing a special peeling mechanism.

Other objects of this invention along with its characteristic features will become apparent from the following description.

BRIEF DESCRIPTION OF THE DRAWINGS

FIGS. 7-A to 7-F are flow charts showing the modes of controlling the electrostatic copying apparatus shown in FIG. 1; and FIGS. 8-A to 8-F are useful for understanding the copying actions of the electrostatic copying apparatus of FIG. 1.

DETAILED DESCRIPTION OF PREFERRED EMBODIMENTS

Figure 1:
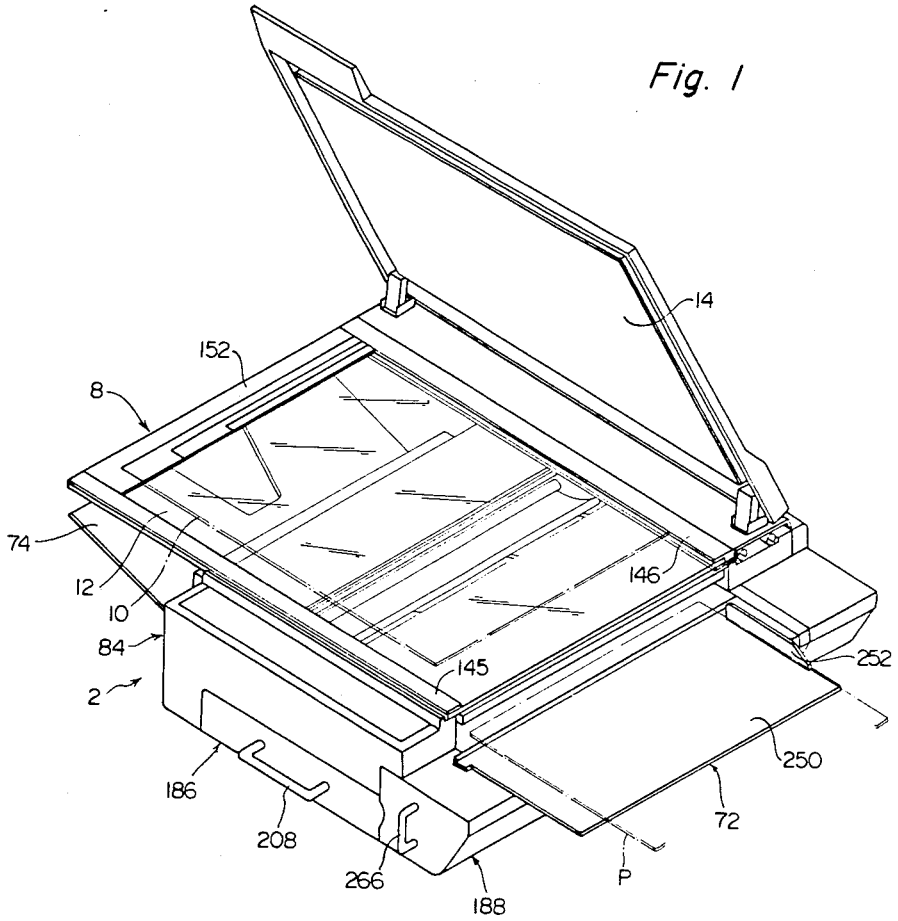
FIG. 1 is a perspective view showing one specific embodiment of the electrostatic copying apparatus construction in accordance with this invention.

With reference to the accompanying drawings, one specific embodiment of the electrostatic copying apparatus constructed in accordance with this invention will be described in detail.

Outline of the Copying Apparatus as a Whole

First, with reference to FIGS. 1 and 2, the entire structure of the electrostatic copying apparatus of this invention in which various improvements have been achieved in accordance with this invention will be described generally.

The illustrated electrostatic copying apparatus has a copying apparatus housing shown generally at 2 (in the illustrated embodiment it is defined by a main supporting structure, a discharge supporting structure, a photosensitive material unit, a development unit, a front cover, a rear cover and a conveying unit, as will be described in detail hereinafter). A document carrying mechanism 8 is mounted on the upper surface of the housing 2 for reciprocating movement in the directions shown by arrows 4 and 6. The document carrying mechanism 8 comprises a transparent plate 12 on which to place a document 10 to be copied and a document holder 14 for covering the document placed on it which can be freely opened or closed (FIG. 1 shows the document holder 14 in an open position at which it causes the transparent plate 12 to be open to view, and FIG. 2 shows it at a closed position at which it covers the transparent plate 12 and the document 10 placed on the transparent plate 12).

Figure 2:
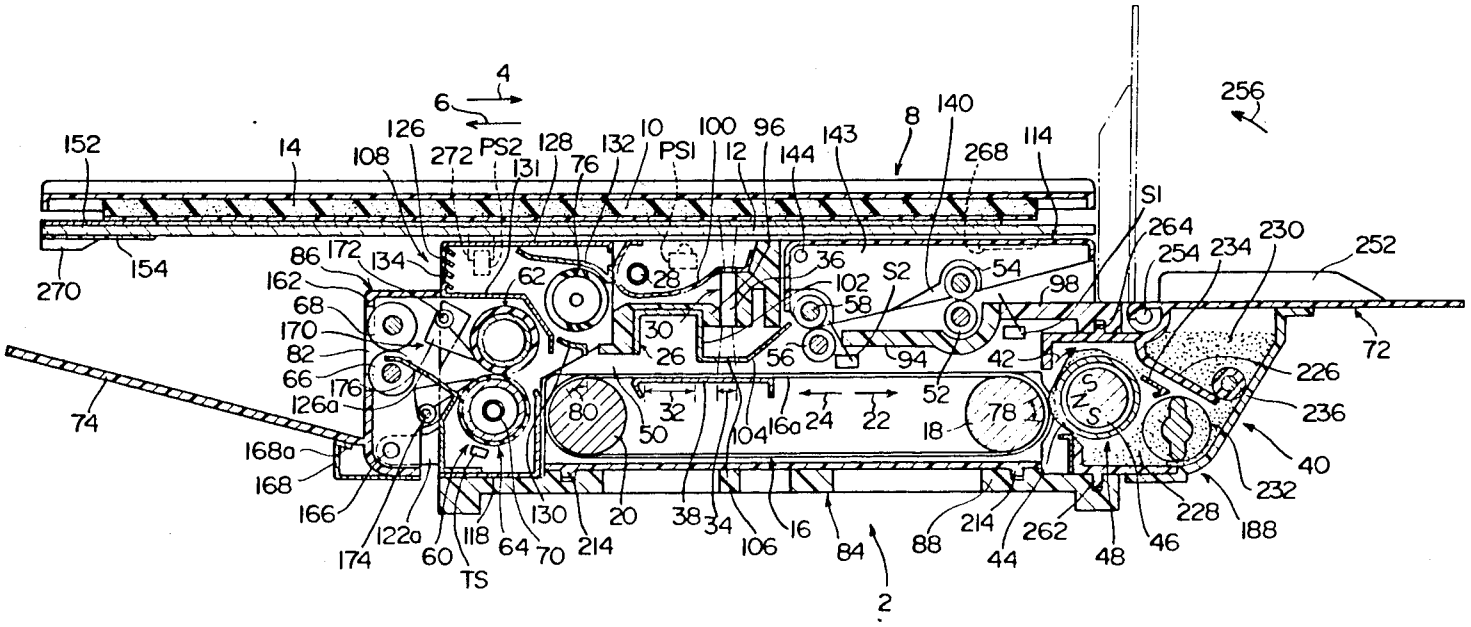
FIG. 2 is a sectional view showing the electrostatic copying apparatus of FIG. 1.

With reference mainly to FIG. 2, a photosensitive material-supporting means having a photosensitive material on at least a part of its peripheral surface, and in the specific embodiment, on substantially the entire periphery thereof, is disposed in the lower portion of the housing 2. The illustrated supporting means is constructed of an endless belt 16. Alternatively, it may be constructed of a known hollow cylindrical drum. But in the electrostatic copying apparatus having the illustrated form, the use of the endless belt 16 makes the apparatus as a whole smaller in size. A pair of rollers 18 and 20 spaced from each other in the lateral direction (the left-right direction in FIG. 2) are disposed within the housing 2, and the endless belt 16 is wrapped about the pair of rollers 18 and 20. The upper travelling portion 16*a* of the endless belt 16 is adapted to be moved in a predetermined direction shown by an arrow 22 and a direction shown by an arrow 24 which is opposite to the predetermined direction.

Above the endless belt 16 within the housing 2 are disposed a corona discharger 26, a lamp 28 and an optical system 30. The corona discharger 26 is provided corresponding to a discharging zone 32 existing around the belt 16, and applies a corona discharge to the discharge zone 32. The corona discharger 26 in the specific embodiment acts selectively as a charging corona discharger, a transfer corona discharger and a charge-eliminating corona discharger, as will be described in detail hereinafter. The lamp 28 and the optical system 30 are disposed in relation to an illuminating zone 34 existing around the belt 16. Light projected from the lamp 28 and reflected from the document carrying mechanism 8 (from the document 10 when it is placed on the document carrying mechanism 8) is projected onto the illuminating zone 34 via the optical system 30. In the illustrated embodiment, the optical system 30 is comprised of many rod-like lenses 36 (for example, rod-like lenses sold under the tradename "Selfoc" by Nippon Sheet Glass Co., Ltd. may be cited as an example). The lamp 28, as will be described hereinafter, acts selectively as a document illuminating lamp and a charge eliminating lamp. In the illustrated embodiment, in order that charging by the corona discharger 26 and illumination by the lamp 28 may be carried out as is desired, the discharging zone 32 and the illuminating zone 34 exist in the upper travelling portion 16*a* of the endless belt 16, and a supporting plate 38 is disposed along substantially the entire width of that part of the underside of the upper travelling portion 16*a* which corresponds to the discharging zone 32 and the illuminating zone 34.

At one end portion (the right end portion in FIG. 2) of the housing 2 is disposed a developing and cleaning device 40 opposite to the roller 18. The developing and cleaning device 40 includes a magnetic brush mechanism 48 (constituting a developer applying means) having a hollow sleeve 44 adapted to be rotated in the direction of an arrow 42 and a permanent magnet 46 disposed within the hollow sleeve 44. A magnetic brush formed by the magnetic brush mechanism 48 acts on the surface of the photosensitive material located at that part of the belt 16 which is wrapped about the roller 18. The developing and cleaning device 40 acts selectively as a developing device and a cleaning device as will be described hereinafter.

A paper conveying passage 50 for conducting a copying paper sheet as is required exists above the belt 16 within the housing 2. The illustrated copying paper conveying means defining the paper conveying passage 50 includes delivery rollers 52 and 54, conveyor rollers 56 and 58, an upper roller 62 and a lower roller 64 of a fixing device 60, and discharge rollers 66 and 68. A heating means 70 such as a heater is disposed within the lower roller 64 of the fixing device 60. A paper feed table 72 for conducting a copying paper to the paper conveying passage 50 is provided at the upstream end of the paper conveying passage 50, and at the downstream end of the paper conveying passage 50 is disposed a paper receiver 74 for receiving copynng paper sheets discharged through the paper conveying passage 50. A cooling fan 76 for discharging and cooling the air within the housing 2 is also provided in the housing 2.

The copying operation of the electrostatic copying apparatus described above will be described generally.

When an image is to be formed on the surface of the photosensitive material, the document carrying mechanism 8 is moved in the direction of an arrow 4, and the upper travelling portion 16*a* of the belt 16 is moved in the direction of an arrow 222. At this time, the coronad-discharger 26, the lamp 28, and the developing and cleaning device 40 act as image forming means. Specifically, the corona discharge 26 acts as a charging corona discharger; the lamp 88, as a document illuminating lamp; and the developing and cleaning device 40, as a developing device. At the time of image formation, the corona discharger 26 uniformly charges the surface of the photosensitive material existing in the discharge zone 32 to a specified polarity. The lamp 28 illuminates a document placed on the document carrying mechanism 8 and light reflected from the document is projected onto the illuminating zone 34 through the rod-like lenses 36. As a result, a latent electrostatic image corresponding to the document is formed on the surface of the photosensitive material disposed on the endless belt 16. The photosensitive material having formed thereon the latent electrostatic image is further moved in the direction shown by arrow 22, and in a zone 78 around the roller 18, the magnetic brush mechanism 48 of the developing and cleaning device 40 applies toner particles to the surface of the photosensitive material, and the latent electrostatic image is developed to a toner image.

Thereafter, at the time of image transfer when the toner image is transferred to a copying paper sheet, the upper travelling portion 16a of the belt 16 is moved in the direction shown by arrow 24. At this time, the corona discharger 26 acts as a transfer corona discharger. At the time of image transfer, a copying paper sheet conveyed through the paper conveying passage 50 closely adheres to the surface of the photosensitive material on the endless belt 16. In the discharge zone 32, the corona discharger 26 applies a corona discharge to the back of the paper sheet closely adhering to the photosensitive material. Consequently, the toner image formed on the photosensitive material is transferred to the copying paper sheet. The paper sheet having the toner image transferred thereto is then peeled from the surface of the photosensitive material in a peeling zone 80 around the roller 20, and further conveyed downstream and undergoes the action of the fixing device 60. In the fixing device 60, the toner image on the copying paper sheet is fixed to the surface of the copying paper sheet by the action of the upper roller 62 and the lower roller 64 having the heating means 70. The copying paper sheet having the toner image fixed thereto is discharged onto the paper receiver 74 through an opening 82 formed in the left wall portion of the housing 2.

When the surface of the photosensitive material after transfer is to be cleaned, the upper travelling portion 16a of the belt 16 is moved in the direction shown by arrow 22. At this time, the corona discharger 26, the lamp 28, and the developing and cleaning device 40 act as cleaning means. Specifically, the corona discharger 26 acts as a charge eliminating corona discharger (in the illustrated embodiment, when the corona discharger 26 is used for charging and transferring, a direct current is supplied, and when it is used for charge elimination, an alternate current is supplied; when it is used as a charge eliminating corona discharger for cleaning, a direct current imparting a charge having an opposite polarity to the charge imparted to the surface of the photosensitive material during image formation, namely a direction current having an opposite polarity to the direct current supplied at the time of image formation, may be supplied in place of the alternate current). The lamp 28 acts as a charge eliminating lamp, and the developing and cleaning device 40 acts as a cleaning device. In the discharging zone 32, the corona discharger 26 applies a corona discharge to the uurface of the photosensitive material after transfer to erase the charge remaining on the photosensitive material. In the illuminating zone 34, the light from the lamp 28 is projected onto the surface of the photosensitive material via the rodlike lenses 36 to ensure erasing of the residual charge on the photosensitive material. Furthermore, in the zone 78, a magnetic brush formed by the magnetic brush mechanism 48 of the developing and cleaning device 40 acts on the surface of the photosensitive material to remove the remaining toner particles from the photosensitive material as is required.

Supporting Structures for the Copying Apparatus

Now, with reference mainly to FIGS. 1 and 3, a supporting structures for the illustrated electrostatic copying apparatus will be described.

The illustrated electrostatic copying apparatus has a main supporting structure 84 and a discharge supporting structure 86. The main supporting structure 84 includes a bottom wall 88, and a vertical front wall 90 and a vertical rear wall 92 which are spaced from each other in the front-rear direction (a direction perpendicular to the sheet surface in FIG. 2, and a direction extending from left bottom to right top in FIG. 3). The vertical front wall 90 extends substantially vertically in an upward direction from the front end portion of the bottom wall 88, and the vertical rear wall 92 extends substantially vertically in an upward direction from the rear end portion of the bottom wall 88. In the illustrated electrostatic copying apparatus, the main supporting structure 84 comprising the bottom wall 88, the vertical front wall 90 and the vertical rear wall 92 is formed in a one-piece unit from a synthetic resin. Furthermore, in relation to this, a plurality of openings are formed in the bottom wall 88 because of a necessity in fabrication. A linking guide portion 94 and a linking fitting portion 96 as additional elements are disposed between the vertical front wall 90 and the vertical rear wall 92. In the illustrated embodiment, the linking guide portion 94 and the linking fitting portion 96 are formed as an integral unit with the main supporting structure 84. Since a part between the paper feed table 72 and the linking guide portion 94 is difficult to fabricate into a one-piece unit, a guide member 98 extending toward the paper feed table 72 is fixed to one end of the linking guide portion 94 by, for example, an adhesive in the illustrated embodiment. With reference to FIG. 2 also, the feed roller 52, the conveying roller 56, the lamp 28, the reflecting plate 100, the rod-like lenses 36 and the corona discharger 26 are disposed between the vertical front wall 90 and the vertical rear wall 92 of the main supporting structure 84. The feed roller 52 and the conveying roller 56 are mounted rotatably between the vertical front wall 90 and the vertical rear wall 92. The lamp 28 is supported in position between the vertical front wall 90 and the vertical rear wall 92. The rod-like lenses 36 are fixed within an elongate through-hole formed in the linking fitting portion 96. The corona discharger 26 has a frame 102 fitted in a recess formed in the under surface of the linking fitting portion 96. At one side end of the frame 102 is provided, as a unit with the frame 102, a guide member 104 extending above the illuminating zone 34 and toward the conveying roller 58. In the guide member 104 is formed an elongate slit opening 106 for regulating the light projected onto the photosensitive material from the lamp 28 through the rod-like lenses 36. In the illustrated embodiments, the guide member 104 is formed as a unit with the frame 102. If desired, it is possible to construct the guide member 104 as a separate member from the frame 102, and to form the slit opening in it. By forming a slit opening in a guide portion (or a guide member) defining the paper conveying passage 50, the need for providing a slit member for exclusive use as in the prior art is obviated, and the structure of the apparatus can be simplified. One side end portion of a reflecting plate 100 extends above the rod-like lenses 36 and fixed to the upper surface of the linking fitting portion 96, and its other side end portion is fixed to part of a fixing unit 108 to be described. In the illustrated embodiment, an elongate opening is formed in one side end portion of the reflecting plate 100 so that the light from the lamp 28 may fall upon the rod-like lenses 36.

The illustrated electrostatic copying apparatus has a front cover 110 defining the front surface of the housing 2 and a rear cover 112 defining the rear surface of the housing 2. In the illustrated embodiment, the front cover 110 is fabricated as a one-piece unit with the main supporting structure 84, and provided in front of the vertical front wall 90 in the frott-rear direction. The rear cover 112 is formed as a separate member from the main supporting structure 84, and mounted in position on the rear surface of the vertical rear wall 92. In the illustrated embodiment, the rear cover 112 is formed separately from the main supporting structure 84 because of some difficulty in fabrication. It is preferred however to form the rear cover 112 also as a one-piece unit with the main supporting structure 84 if a fabrication technique capable of achieving it is available. This will reduce the number of component parts and simplify the assembling operation.

The fixing unit 108, the conveying unit 114 and the document carrying mechanism 8 are further mounted on the main supporting structure 84 described hereinabove. In the illustrated embodiment, the discharge supporting structure 86 is further mounted on the fixing unit 108. With reference to FIGS. 2 and 3, a fixing unit frame 116 mounted on the bottom wall 88 of the main supporting structure 84 has a bottom wall 118 and a front wall 120, a rear wall 122, a right side wall 124 and a left side wall 126 which extend upwardly from the bottom wall 118, and an upper wall 128. The upper roller 62 and the lower roller 64 are rotatably mounted between the front wall 120 and the rear wall 122, and the cooling fan 76 is supported rotatably on the rear wall 122. In relation to the cooling fan 76, plate members 130 and 131 are fixed below it, and a plate member 132 above it, between the front wall 120 and the rear wall 122. An opening is formed in the right side wall 124, and in the left side wall 126, an air discharge opening 134 is formed at its upper portion, and an opening at its middle portion. In the illustrated embodiment, the upper end portion 126*a* of the lower portion of the left side wall 126 extends toward the discharge roller 66 and acts to conduct the copynng paper sheet to a nipping portion between the discharger rollers 66 and 68. The conveying unit 114 has a conveying unit frame 136 having a front wall 138, a rear wall 140 and an upper wall 142. Between the front wall 138 and the rear wall 140, the feedrroller 54 and the conveying roller 58 are rotatably mounted. Furthermore, on the under surface of the upper wall 142, a plurality of downwardly projecting guide pieces 143 are provided between the front wall 138 and the rear wall 140 is a spaced-apart relationship in the front-rear direction. The conveying unit frame 136 and the guide pieces 143 are fabricated as a one-piece unit from a synthetic resin. In the illustrated embodiment, the conveying unit 114 is pivotably mounted on the vertical front wall 90 and the vertical rear wall 92 of the main supporting structure 84 via a pin member 144, and is free to pivot between a closed position shown in FIG. 2 and an open position shown in FIG. 4 about the pin member 144 (constituting a center of pivoting at its upper end portion on that side on which the conveying roller 58 is mounted) as a center. The document carrying mechanism 8 is supported on the upper ends of the vertical front wall 90 and the vertical rear wall 92 of the main supporting structure 84 so as to move freely in the directions shown by arrows 4 and 6. The document carrying mechanism 8 includes the transparnnt plate 12, and supporting members 145 and 146 are mounted on the front and rear ends of the transparent plate 12. The supporting member 145 mounted on the front edd of the transparent plate 12 is supported movably directly on a shoulder portion provided at the upper end of the vertical front wall 90, and the supporting member 146 mounted on the rear end of the transparent plate 12 is mounted on a fitting body 148 which is movably supported on the upper end of the vertical rear wall 92 through a sliding mechanism 150 such as Aculide (tradename). The document holder 14 is mounted as shown in FIG. 1 on the upper surface of the fitting body 148 so that it can be opened and closed freely. The supporting members 145 and 146 mouneed on the transparent plate 12 may be omitted. In such a case, the front end portion is directly supported movably on the upper end of the vertical front wall 90 of the main supporting structure 84, and its rear end portion is mounted on the fitting body 148. In the illustrated embodiment, a document positioning member 152 (FIG. 1) is bonded to the upper surface of the left end of the transparent plate 12 substantially along its entire width, and a tape 154 having a surface with white characteristics is bonded to the under surface of the transparent plate 12 (FIG. 2) corresponding to the document positioning member 152. A paint having white characteristics may be coated instead of bonding the tape 154 having white characteristics. The document carrying mechanism 8 is free to reciprocate between a start-of-scan position shown in FIG. 4 and a charge eliminating position to be described hereinafter via an end-of-scan position.

Furthermore, the discharge supporting structure 86 is mounted on the fixing unit 108. The illustrated discharge supporting structure 86 comprises a bottom wall 156, a front wall 158, a rear wall 160, a left side wall 162 and an upper wall 164, and the front wall 158 and the eear wall 160 are pivotably mounted on a projection 120*a* (FIG. 3) provided in the front wall 120 of the fixation unit frame 116 and a projection 122*a* (FIG. 2) provided in the rear wall 122 of the fixation unit frame 116 via a pin member 166 (FIG. 2). The discharge supporting structure 86 is fabricated in a one-piece unit from a snnthetic resin. In the illustrated embodiment, a discharge opening is formed in the left side wall 162 of the discharge supporting structure 86, and the paper receiver 74 is provided in relation to the discharge opening. The paper receiver 74 is fommed as an integral unit with the discharge supporting structure 86. Desirably, the base portion (that site which is connected to the left side wall 162) of the paper receiver 74 has flexibility as can be easily understood from the following description, and in the illustrated embodiment, it is progressively narrow in a wedge shape from its forward end portion to its base as shown in FIG. 2. In relation to the paper receiver 74, the discharge supporting structure 86 further has provided therein a stop piece 168 which extends from its one end fixed to the bottom wall 156 of the discharge supporting structure 86 toward its other end in the left direction in FIG. 2, and further extends upwardly. An abutting portion 168*a* is provided at the upwardly extending other end of the stop piece 168. Hence, the paper receiver 74 abuts against the abutting portion 168*a* of the stop piece 168 by its own weight, and held at a receiving position shown in FIG. 2 (a position convenient for receiving copying paper sheets). The discharge rollers 66 and 68 and a separating mechanism 170 are mounted on the discharge supporting sturcture 86. The discharge rollers 66 and 68 are mounted rotatably between the front wall 158 and the rear wall 160 of the discharge supporting structure 86. The separating mechanism 170 has an upper supportin shaft 172 and a lower supporting shaft 174 on which a plurality of axially spaced separating claws 176 are mounted. The upper supporting shaft 172 and the lower supporting shaft 174, spaced from each other vertically, are mounted between the front wall 158 and the rear wall 160 of the discharge supporting structure 86. The discharge supporting structure 86 are free to move between a closed position shown in FIG. 2 and an open position shown in FIG. 4. Having regard to the fact that the discharge supporting structure 86 is movable, a lock mechanism 178 for releasably holding the discharge supporting structure 86 at the above closed position is provided in relation to the main supporting structure 84 and the discharge supporting structure 86. With reference to FIG. 4, the lock mechanism 178 includes a shaft member 180 fixed between the front wall 120 and and the rear wall 122 of the fixing unit 108 in the discharge supporting structure 86 and an engaging member 184 mounted pivotably on a supporting shaft 182 fixed between the front wall 158 and the rear wall 160 in the discharge supporting structure 86. The engaging member 184 is L-shaped. At one end portion thereof, an engaging portion **184*a* capable of engaging the shaft member 180 is provided, and its other end portion constituting an operating portion 184*b* projects upwardly through an opening formed in the upper wall 164 of the discharge supporting structure 86 (see FIG. 3** also).

In the illustrated electrostatic copying apparatus, the endless belt 16 having the photosensitive material disposed thereon is constructed as a photosensitive material unit 186, and the developing and cleaning device 40 is constructed as a developing unit 188. The photosensitive material unit 186 and the developing unit 188 are mounted detachably on the main supporting structure 84. The photosensitive material unit 186 and the developing unit 188 will be described in detail hereinafter.

Figure 3:
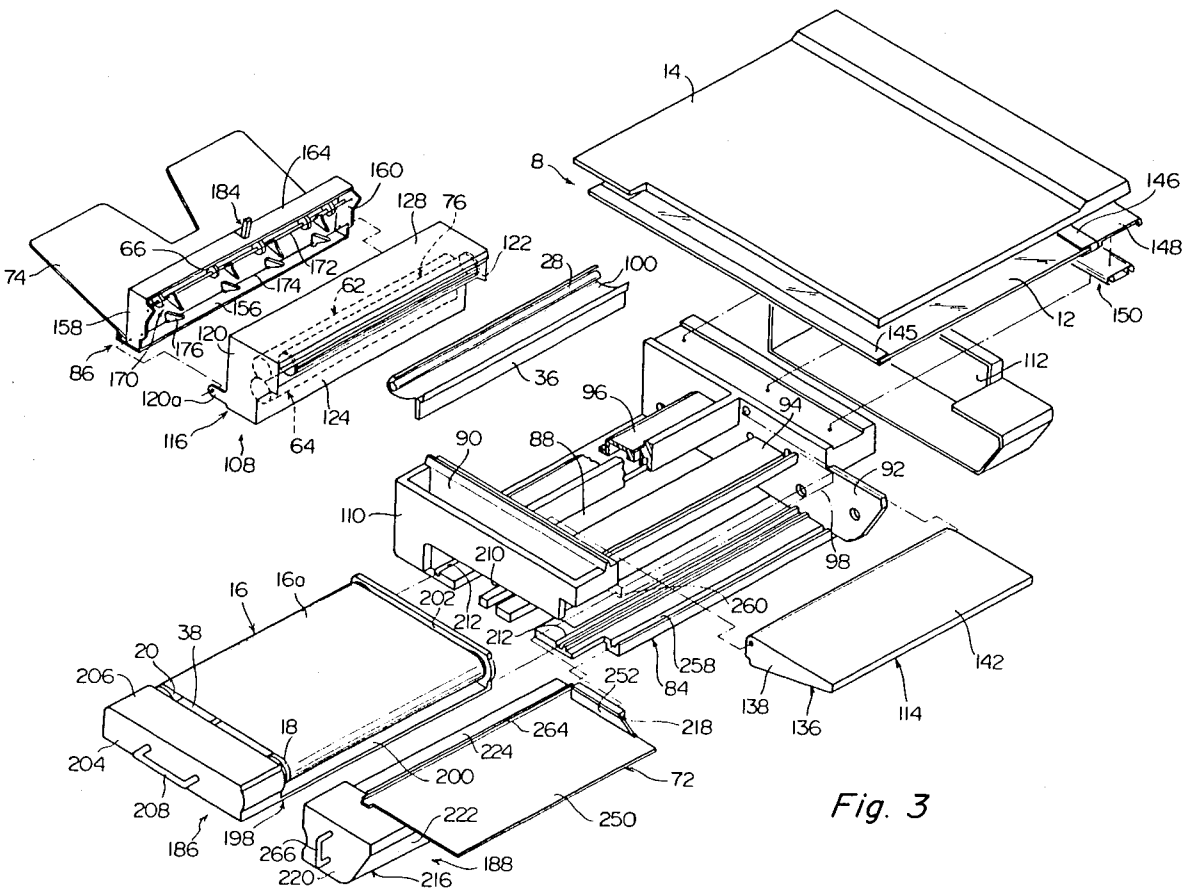
FIG. 3 is an exploded perspective view showing the electrostatic copying apparatus of FIG. 1.
Figure 4:
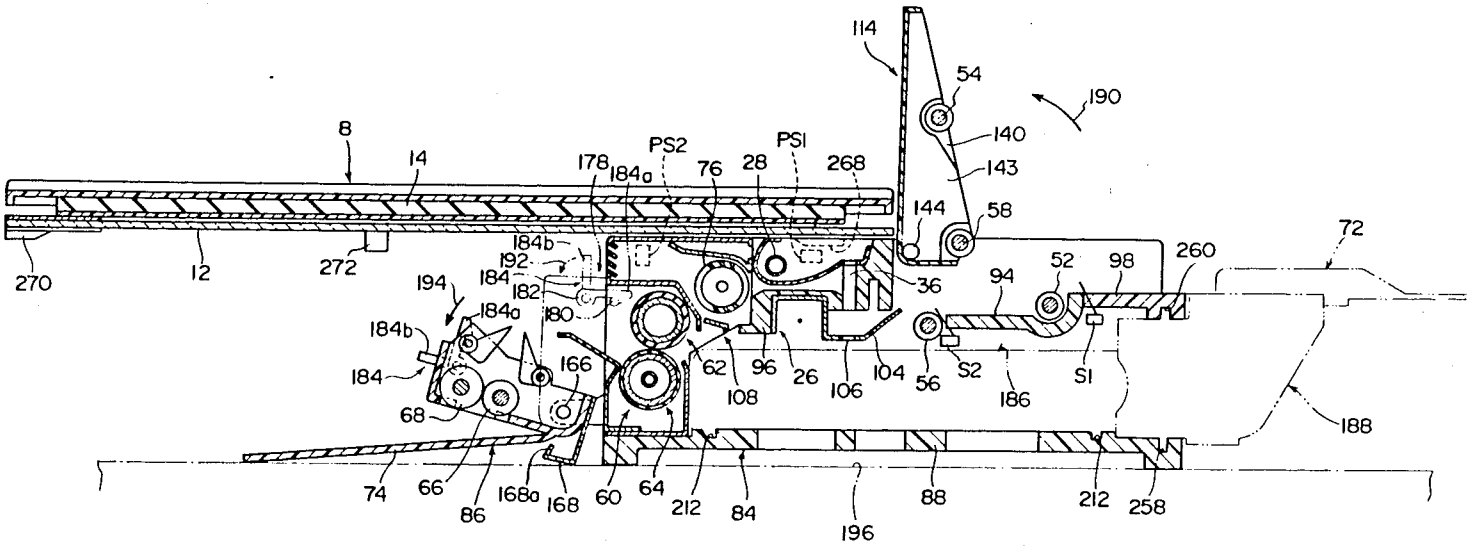
FIG. 4 is a sectional view showing the parts of a paper conveying passage in the electrostatic copying apparatus of FIG. 1 in the open state.

It will be easily understood therefore from FIGS. 1 to 3 that the upper wall 142 of the conveying unit 114 and the upper wall 128 of the fixing unit 108 defines the upper surface of the housing 2, and between the upper wall 142 and the upper wall 188, an opening exists for the lamp 28 to illuminate a document placed on the document carrying mechanism 8 and to conduct the light reflected from the document to the rod-like lenses 36. Furthermore, the left side wall 134 of the fixing unit 108 and the left side wall 162 of the discharge supporting structure 86 define the left surface of the housing 2, and the front cover 110 formed as an integral unit with the main supporting structure 86 defines the front surface of the housing 2. The rear cover 112 mounted on the vertical rear wall 92 of the main supporting structure 86 defines the rear surface of the housing 2. Furthermore, the bottom wall 88 of the main supporting structure 84, together with part of the photosensitive material unit 186, defines the under surface of the housing 2. With regard to the paper conveying passage 50, the guide member 98, the delivery roller 52, the linking guide portion 94 and the conveying roller 56 define the under side of its upstream portion for conducting a copying paper sheet to the electrical discharge zone 32, and the guide piece 143 of the conveying unit 114, the delivery roller 54, the conveying roller 58 and the guide portion 104 provided as an integral unit with the frame 102 of the corona discharger 26 define the upper side of the above upstream portion. Furthermore, the lower roller 64, the separatin claws 176 mounted on the lower supporting shaft 174, the upper end portion **126*a* of the lower portion of the left side wall 126 of the fixing unit 108, and the discharge roller 66 define the under side of the downstream portion of the paper conveying passage 50 for discharging the copying paper sheet from the electrical discharge zone 32 out of the housing 2. The upper roller 62, the separating claws 176 mounted on the supporting shaft 172, and the discharge roller 68** define the upper side of the above downstream portion.

In the illustrated electrostatic copying apparatus, part of the paper conveying passage 50 is constructed such that it can be opened at a plurality of parts, as shown in FIG. 4. Thus, a copying paper sheet that has jammed can be easily removed from the open parts. In relation to the upstream portion of the paper conveying passage 50, the conveying unit 114 is free to pivot between the closed position shown in FIG. 2 and the open position shown in FIG. 4. When the conveying unit is at the closed position, the delivery roller 54 and the conveying roller 58 of the conveying unit 114 are brought into press contact with the delivery roller 52 and the conveying roller 56 mounted on the main supporting structure 84, and the copying paper sheet can be conveyed as described hereinabove, as can be seen from FIG. 2. The conveying unit 114 can be brought from the closed position to the open position by holding the document carrying mechanism 8 at the start-of-scan position shown in FIG. 4 (by this positioning, the top of the conveying unit 114 is opened, and the conveying unit 114 can pivot) and then pivoting it in the direction shown by an arrow 190 (FIG. 4). When the conveying unit 114 is held at the open position, the nipping between the delivery rollers 52 and 54 and the nipping between the conveying rollers 56 and 58 are released, and the upstream portion of the paper conveying passage 50 are opened as is required. If desired, there can be provided a lock mechanism (not shown) for releasably holding the conveying unit 114 at the closed position. Furthermore, in relation to the downstream portion of the paper conveying passgge 50, the discharge supporting structure 86 is free to pivot between the closed position shown in FIG. 2 and the open position shown in FIG. 4. When the discharge supporting structure 86 is held at the closed position by the lock mechanism 178, the front end portions of the separating claws 176 mounted on the lower supporting shaft 174 act on the peripheral surface of the lower roller 64 and the front end portions of the separating claws 176 mounted on the upper supporting shaft 172 act on the upper roller 62, as shown in FIG. 2. As a result, the copying paper sheet can be discharged onto the paper receiver 74 as described hereinabove. The discharge supporting structure 86 can be brought from the closed position to the open position by pivoting the operating portion **184*a* of the engaging member 184 in the direction shown by an arrow 192 (FIG. 4) in a two-dot chain line to cancel engagement between the engaging portion 184*a* and the shaft member 180 (by cancelling the engagement, the discharge supporting structure 86 can pivot freely), and thereafter, pivoting the discharge supporting structure 86 in the direction of arrow 194 (FIG. 4). As can be sen from FIG. 4, when the electrostatic copying apparatus is placed on a supporting table 196 as shown by a one-dot chain line in FIG. 4, the discharge supporting structure 86 is held at the above open position by the abutting of the front end portion of the paper receiver 74 against the upper surface of the supporting table 196. When, for example, it is placed on the edge portion of the supporting table 196, the dicharge supporting structure 86 is held at the above open position by the abutting of part of the stop piece 168** against part of the main supporting structure 84. At the open position, the separating claws 176 of the separating mechanism 170 move away from the upper roller 62 and the lower roller 64 of the fixing device 60, and the downstream portion of the paper conveying passage 50 (in the illustrated embodiment, a part between the nipping position between the upper roller 62 and the lower roller 64 of the fixing device 60 and the nipping position between the discharge rollers 66 and 68) is opened. In the illustrated embodiment, the base portion of the paper receiver 74 has flexibility. Hence, when the apparatus is placed as shown in FIG. 4 and the discharge supporting structure 86 is pivoted in the direction of arrow 194, the front end portion of the paper receiver 74 abuts against the upper surface of the supporting table 196. Thereafter, the paper receiver 74 is pivoted slightly clockwise in FIG. 4 relative to the discharge supporting structure 86. As a result, the discharge supporting structure 86 is maintained in the state shown in FIG. 4, and in spite of the relatively large length of the paper receiver 74 in the left-right direction (the left right direction in FIGS. 2 and 4), the downstream portion of the paper conveying passage 50 can be opened relatively widely. Furthermore, in relation to the discharge zone 32 and the illuminating zone 34 (which exist in the middle part of the paper conveying passage 50), the photosensitive material unit 186 can be mounted detachably on the main supporting structure 84. When the photosensitive material unit 186 is removed from the main supporting structure 84, the electrical discharge zone 32 and the illuminating zone 34 are opened at the bottom as shown in FIG. 4.

In the supporting structures described hereinabove, the main supporting structure 84 is fabricated in a one-piece unit from a synthetic resin. Hence, its structure is relatively simple, and the number of component parts is small. Furthermore, the assembling operation is simple. Furthermore, since the discharge supporting structure 86 and the paper receiver 74 are fabricated likewise in a one-piece structure from a synthetic resin, the same statement as above can be applied to the discharge supporting structure 86.

Structures of the Photosensitive Material Unit and the Developing Unit

Now, with reference mainly to FIGS. 2 and 3, the photosensitive material unit 186 and the developing unit 188 will be described.

The photosensitive unit 186 has a supporting unit frame 198 which has a bottom wall 200, a front wall (not shown) and a rear wall 202 disposed on the bottom wall 200 in a spaced-apart relationship in the front-rear direction, and a front cover wall 204 disposed ahead of the front wall. These walls are formed as a one-piece unit from a synthetic resin. Between the front wall and the rear wall 202, the roller 18 is rotatably mounted on one end portion (the right end portion in FIG. 2) of the front wall and rear wall 202, and the roller 20 is rotatably mounted on the other one portion (the left end portion in FIG. 2) thereof. The endless belt 16 is wrapped between rollers 18 and 20, and the photosensitive material is disposed on the surface of the endless belt. In the specific embodiment, the upper travelling portion **16*a* of the endless belt 16 is moved in the direction of arrow 22 during image formation and in the direction of arrow 24 during transfer. It is important therefore that the length of the photosensitive material in its moving direction should be equal to, or larger than, the maximum copyable length. In relation to the upper travelling portion 16*a* of the endless belt 16, a supporting plate 38 is disposed beneath it, and the two ends of the supportnng plates 38 are fixed respectively to the front wall (not shown) and the rear wall 202. The supporting unit frame 198 further includes a cover wall 206 which is fixed between the front wall and the front cover wall 204 to cover the space between the two walls. A holding portion 208 is provided in the front surface of the front cover wall 204 of the supporting unit frame 198 in order to mount the photosensitive material unit 186** detachably.

The photosensitive unit 186 is adapted to be mounted on, or detached from the main supporting structure 84 by moving it in the front-rear direction. Specifically, opening portions 210 (only the opening portion formed in the front cover 110 is shown in FIG. 3), aligned in the front-rear direction, are formed in the front cover 110 and the front wall 90 of the main supporting structure 84. The photosensitive material unit 186 is mounted detachably on the main supporting structure 84 through the opening portions 210, and a guide means for guiding the photosensitive unit 186 in the front-rear direction is annexed. The guide means includes a guiding portion provided in the main supporting structure 84 and a guided portion provided in the photosensitive unit 186. In the illustrated embodiment, the guiding portion is comprised of a pair of guide grooves 212 provided on the upper surface of the bottom wall 88 of the main structural unit 84 in a spaced-apart reationship in the left-right direction, and the guide grooves 212 extend in the front-rear direction. The guided portion of the guide means is comprised of a pair of protrusions 214 which can engage the guide grooves 212 and are provided in the under surface of the bottom wall 200 of the supporting unit frame 198. Accordingly, the photosensitive material unit 186 can be detachably mounted on the main supporting structure 84 by bringing the protrusions 214 of the photosensitive material unit 186 into engagement with the guide grooves 212 of the main supporting structure 84 and moving them rearwardly along the guide grooves 212 in the front-rear direction. When the photosensitive material unit 186 is thus mounted in position on the main supporting structure 84, the state shown in FIGS. 1 and 2 is created and the copying operation becomes possible. It will be easily understood from FIG. 1 that in the above mounted state, the front cover portion 204 of the photosensitive unit 186 defines part of the front surface of the housing 2, and furthermore, as can be seen from FIG. 2, the bottom wall 200 defines the lower surface of the housing 2 together with the bottom wall 88 of the main supporting structure 84. On the other hand, the photosensitive material unit 186 can be detached from the main supporting structure 84 by holding the holding portion 208 provided in the photosensitive unit 186 and moving it along the uuide groove 212 frontwardly in the front-rear direction. Desirably, a locking mechanism (not shown) for releasably maintaining the photosensitive material unit 186 in the above mounted state is provided in relation to the photosensitive material unit 186.

Figure 5:
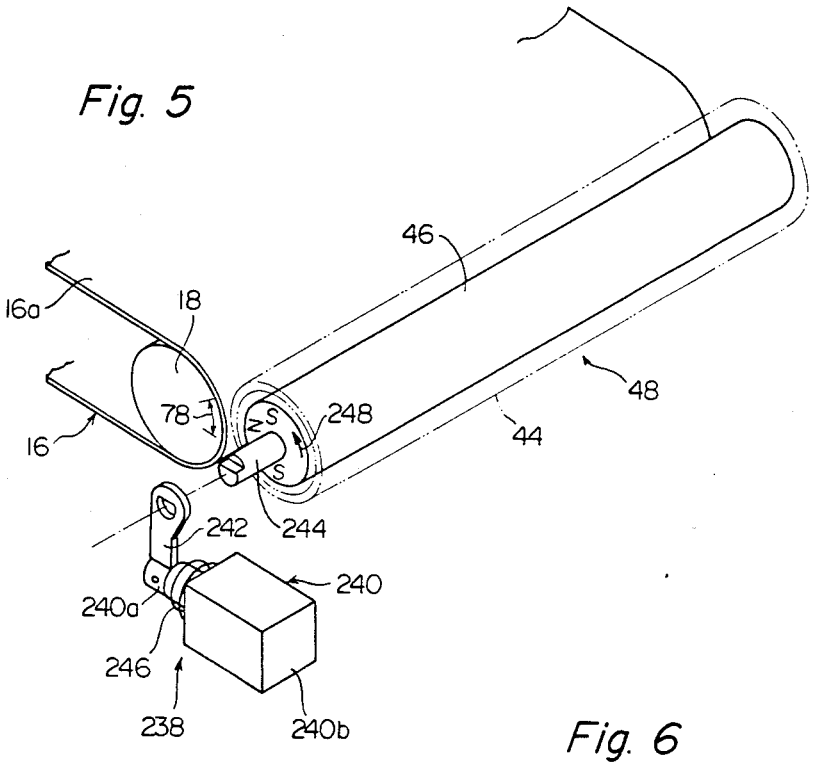
FIG. 5 is a partial perspective view showing a magnetic brush mechanism and its related elements in the developing and cleaning device in the electrostatic copying apparatus shown in FIG. 1.
Figure 6:
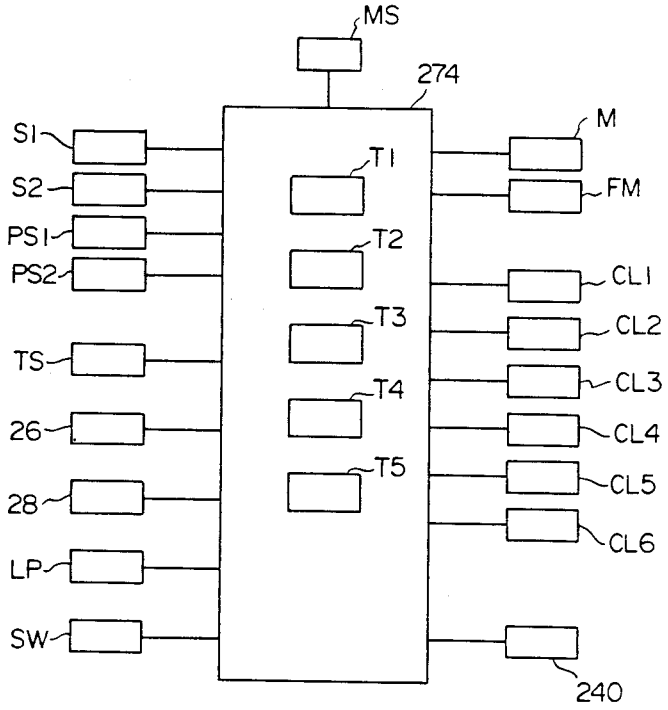
FIG. 6 is a view showing a control system of the electrostatic copying apparatus of FIG. 1 in a simplified form.

The developing unit 188 will now be described. The illustrated developing unit 188 has a developing unit frame 216 including a front wall (not shown) and a rear wall 218 disposed in a spaced-apart relationship in the front-rear direction and a front cover wall 220 disposed ahead of the front wall. These walls together with a housing wall 220 are formed in a one-piece unit from a synthetic resin. The developing unit 188 hss an upper wall 224 and a partition wall 226 formed in a one-piece unit from a synthetic resin. The upper wall 224 covers an upper surface between the front cover wall 220 and the rear wall 216, and the partition wall 226 divides a space between the front wall (not shown) and the rear wall 218 into a development receptacle portion 228 and a toner particle accommodating portion 230. In other words, the front wall, the rear wall 218, the housing wall 222, the upper wall 224 and the partition wall 226 define a development receptacle for holding a developer composed of carrier particles and toner particles in the lower portion of the developing unit 188 in the illustrtted embodiment, and the front wall, the rear wall 218, the housing wall 222 and the partition wall 226 define a receptacle for holding toner particles in the upper portion of the developing unit 188 in the illustrated embodiment. Within the development receptacle are disposed the magnetic brush mechanism 48, a developer agitating meass 232 and a guide plate 234 which constitute a developer applying means. Within the toner particle holding receptacle, a toner particle feed roller 236 is disposed in an opening portion existing between the inside surface of the housing wall 222 and the front end of the partition wall 226. The magnetic brush mechanism 48, as stated hereinabove, has the hollow sleeve 44 and the permanent magnet 46 disposed therein, and the hollow sleeve 44 and the permanent magnet 46 are rotatably supported between the front wall (not shown) and the rear wall 218. In relation to the permanent magnet 46, an actuating means 288 is annexed as shown in FIG. 5. The illustrated actuating means 238 is comprised of an electromagnetic solenoid 240. Its output terminal **240*a* is linked to one supporting portion 244 for the permanent magnet 46 via a lever member 242, and a coil spring 246 is interposed between the main body 240*b* of the electromagnetic solenoid 240 and the lever member 242. The permanent magnet 46 is cylindrical, and a plurality of magnetic poles are disposed on its peripheral surface in a spaced-apart relationship in the circumferential direction (in the illustrated embodiment, two S poles and one N pole exist and the N pole is disposed between the S poles). Hence, in the illustrated embodiment, when the electromagnetic solenoid 240 is energized, the permanent magnet 46 is held at a first angular position shown in FIGS. 2 and 5, at which a particular S pole of the two S poles of the permanent magnet 46 (the S pole existing on the lower side) is positioned in a developer drawing zone and the N pole is positioned at a site substantially opposite to the zone 78 (FIG. 2). As a result, in the developer drawing zone, the developer in the development receptacle 228 is held by the magnetic brush mechaiism 48, and a magnetic brush generated by the magnetic brush mechanism 48 acts on the photosensitive material on the endless belt 16 in the zone 78. On the other hand, when the electromagnetic solenoid 240 is deenergized, the permanent magnet 46 is slightly turned in the direction shown by an arrow 248 via the lever member 242 whereby the N pole is slightly deviated from the position opposing the zone 78 and the particular S pole is slightly deviated from the developer drawing zone. As a resllt, the magnetic brush generated by the magnetic brush mechanism 48 does not substantially act on the surface of the photosensitive material in the zone 78**.

In the developing and cleaning device 40 described above, the developer agitated by the agitating means 232 is supplied to the magnetic brush mechanism 48. The magnetic brush mechanism 48 holds the developer on the peripheral surface of the hollow sleeve 44 in the developer drawing zone and conveys it through the zone 78. In the zone 78, the developer held on the surface of the hollow sleeve 44 acts on the surface of the photosensitive material on the endless belt 16 whereby during image formation a latent electrostatic image formed on the photosensitive material is developed to a toner image and during cleaning, toner particles remaining on the photosensitive material are removed (when the permanent magnet 46 is held at the first angular position). The developer conveyed through the zone 78 is then removed from the surface of the hollow sleeve 44, moved downwardly over the guide plate 234 and dropped onto the agitating means 232. When the proportion of the toner particles in the developer is decreased, the toner particle supply roller 236 is rotated as is required, and the toner particles in the toner particle holding receptacle are fed toward the agitating means 232 in the development receptacle through the opening existing between the housing wall 222 and the partition wall 226.

As shown in FIGS. 1 to 3, the paper feed table 72 is mounted on the developing unit 188. The paper feed table 72 has a table portion 250 and a guide portion 252 projecting substantially perpendicularly upwardly at one end of the table portion 250. The front end part of the table portion 250 is mounted pivotally on the upper wall 224 via a pin member 254. The paper feed table 72 can freely move between a first position shown by the solid line in FIG. 2 and a second position shown by the two-dot chain line in FIG. 2. At the first position, the paper feed table 72 covers an opening existing between the housing wall 222 and the upper wall 224, i.e. a supply opening for the toner particle holdingrreceptacle, and at the second position, leaves open the above toner supply opening. Accordingly, by pivoting the paper feed table 72 in the direction of arrow 256 about the pin member 254 as a center and holding it at the second position, fresh toner particles can be supplied to the toner particle holding receptacle from the supply opening.

The developing unit 18 is also adapted to be mounted on, or detached from, the main supporting structure 84 by moving it in the front-rear direction. Specifically, in the illustrated embodiment, the developing unit 188 is detachably mounted on the main supporting structure 84 via the opnnings 210 formed in the front cover 110 and the front wall 90 of the main supporting structure 84 as is the photosensitive material unit 186 (the photosensitive material unit 186 is detachably mounted on the lower portion of the nearly central part of the housing 2, and the developing unit 888 is detachably mounted on one end portion of the housing 2 upstream of the paper conveying passage 50). In relation to the developing unit 188, a guide means is annexed for guiding the developing unit 188 in the front-rear direction. The guide means includes a guiding portion provided in the main supporting structure 84 and a guide portion provided in the developing unit 188. In the illustrated embodiment, the guiding portion is comprised of a guide groove 258 provided in the bottom wall 88 of the main supporting structure 84 and a guide groove 260 formed in the under surface of the guide member 98 fixed tothe linking guide portion 94 of the main supporting structure 84, and the guide grooves 258 and 260 extend in the front-rear direction. The guided portion is comprised of a protrusion 262 capable of being received in the guide groovss 258 and provided in the under surface of the bottom part of the housing wall 222 in the developing unit 188 and a protrusion 264 capable of being received in the guide groove 260 and provided in the upper surface of the upper wall 224 of the developing unit 188. Hence, the developigg unit 188 can be detachably mounted on the main supporting structure 84 by bringing the protrusions 262 and 264 of the developing unit 188 into contact with the guide grooves 258 and 260 in the main supporting structure 84 and by moving them in the front-rear direction along the guide grooves 258 and 260. When the developing unit 188 is thus mounted in position, the state shown in FIGS. 1 and 2 is created, and the copying operation becomes possible. It will be easily understood that in the above mounted state, the front cover wall 220 of the developing unit 188 defines part of the front surface of the housing 2, and the housing wall 222 defines the right side of the housing 2. When the paper feed table 72 is at its first position, the upper surface of the table portion 250 and the upper surface of the guide member 98 in the main supporting structure 84 define the same substantially horizontal plane. On the other hand, the developing unit 188 can be detached from the main supporting structure 84 by holding the holding portion 266 provided in the front surface of the front cover wall 220 of the developing unit 188 and moving it along the guide grooves 258 and 260 forwardly in the frontrear direction. Desirably, a locking mechanism (not shown) for releasably maintaining the developing unit 188 in the mounted state is annexed in relation to the developing unit 188.

Control System for the Copying Apparatus

Now, with reference to FIGS. 2 to 6, the control system for the illustrated electrostatic copying apparatus will be described.

In the illustrated electrostatic copying apparatus, a first copying paper detecting means S1 and a second copying paper detecting means S2 for detecting copying paper in the paper conveying passage 50 are provided. The first paper detecting means S1 is disposed upstream of the delivery rollers 52 and 54 and detects paper inserted into the paper conveying passage 50. The second paper detecting means S2 is disposed between the delivery rollers 52 and 54 and the conveying rollers 56 and 58, and detects paper delivered by the delivery rollers 52 and 54. In the moving path of the docmment carrying mechanism 8 are provided a first position detecting means PS1 and a second position detecting means PS2 for detetting the position of the document carrying mechanism 8. The first position detecting means PS1 is constructed of a mechanical switch and detects projecting pieces 268 and 270 provided on the under surfaces of two opposite ends in the longitudinal direction of the fitting body 148 of the document carrying mechanism 8. The second position detecting means PS2 is constructed of an optical switch composed of a combination of a light emitting element and a light receiving element, and detects a plate piece 272 provided on the under surface of the nearly central part of the fitting body 148 in the longitudinal direction. Furthermore, a temperature detecting means TS is annexed in relation to the heating means 70 disposed in the lower roller 64 of the fixing device 60 (see FIG. 2 also). The temperature detecting means TS detects the temperature of the peripheral surface of the lower roller 64. The electrostatic copying apparatus includes a control means 274 for actuating and controlling the copying apparatus, and signals from the first and second paper detecting means S1 and S2 the first and second position detecting means PS1 and PS2 and the temperature detecting means TS are fed to the control means 274. The electrostatic copying apparatus is further equipped with a main switch MS, and signals from the main switch MS are also fed to the control means 274.

A driving system for the illustrated electrostatic cppying apparatus includes a main motor M constituting a main driving source, a fan motor FM for rotating the cooling fan 76, and six clutch means CL1 to CL6. The clttch means CL1 is disposed in relation to the delivery roller 52, and when energized, drivingly connects the delivery roller 52 to the main motor M and rotates it counterclockwise in FIG. 2. The clutch means CL2 is disposed in relation to the conveying roller 56, and when energized, drivingly connects the conveying roller 56 to the main motor M and rotates it counterclockwise in FIG. 2. The clutch means CL3 is disposed in relation to the roller 18 on which the endless belt 16 is wrapped, and when energized, drivingly connects the roller 18 to the main motor M and rotates it clockwise in FIG. 2. The clutch means CL4 is disposed in relation to the oher roller 20 on which the endless belt 16 is wrapped, and when energized, drivingly connects the roller 20 to the main motor M and rotates it counterclockwise in FIG. 2. The clutch means CL5 and CL6 are disposed in relation to the document carrying mechanism 8. When the clutch means CL5 is energized, the document carrying mechanism 8 is mvved in the direction shown by arrow 4 by the action of the main motor M. When the clutch means CL6 is energized, the document carryigg mechanism 8 is moved in the direction shown byarrow 6 by the action of the main motor M.

An electric motor (not shown) is provided for exclusive use by the toner particle feed roller 236. When this motor is energized, the toner particle feed roller 236 is rotated and feeds toner particles. This electric motor is energized continuously or intermittently, and supplies a predetermined amount of the toner particles. The main motor M, the fan motor FM and the clutch means CL1 to CL6 are actuated and controlled by signals from the control means 274. The control means 274 also actuates and controls a switch means SW for switching over electric currents supplied to the electromagnetic solenoid 240, the corona discharger 26, the lamp 28, the lamp LP and a switch means SW for changing over the current supplied to the corona discharger 26 (switching over between a dc current and an ac current). The control means 274 in the illustrated embodiment includes timer means T1 to T5.

Copying Operation

Now, with reference mainly to FIGS. 7-A to 7-F and FIGS. 8-A to 8-F, the copying operation of the illustrated electrostatic copying apparatus will be described.

To perform the copying operation, the main switch MS is first closed (on). As a result, step n-1 ends and step n-2 sets in, and the heating means 70 of the fixing device 60 is energized to start heating of the fixing device 60. When the detected value of the temperature detecting means TS exceeds a predetermined value, warm up of the copying apparatus is over, and the lamp LP indicating copyability is turned on in step n-3. When the lamp LP is on, the copying actions to be described below are possible.

Then, a document 10 to be copied is placed in position on the transparent plate 12 of the document carrying mecaanism 8. Specifically, the rear end the document 10 is positioned on the side edge of the document positioning member 152 and the rear side edge (that side edge which is located on the top right in FIG. 1) of the document 10 is positioned on the side edge of the supporting member 146 on the rear side, as shown by the one-dot chain line in FIG. 1. Thereafter, as shown in FIG. 8-A, the copying paper P is positioned on the paper feed table 72, and inserted into the upstream end of the paper conveying passage 50 through the opening existing between the upper surface of the guide member 98 of the main supporting structure 84 and the lower surface of the guide protrusion 143 of the conveying unit 114 (see FIG. 1 also). When the leading end of the inserted paper P reaches the first paper detecting means S1, the first paper detecting means S1 sets in operation, and the advance is made from step n-4 to step n-5. When the main motor M is energized in step n-5, the hollow sleeve 44 of the magnetic brush mechanism 48 of the developing and cleaning device 40 is rotated in the direction of arrow 42 (FIG. 8-B) and the agitating means 232 is also rotated in a predetermined direction, by the action of the main motor M. Furthermore, the lower roller 64 of the fixing device 60 and the discharge roller 66 are also driven, and thereby, the upper roller 62 of the fixing device 60 and the discharge roller 68 follow the rotation of the lower roller 64 and the discharge roller 66, respectively. When the clutch means CL1 is energized, the delivery rollers 52 and 54 are rotated via the clutch means CL1, and the paper P fed to the paper conveying passage 50 as stated hereinabove is further advanced downstream by the action of the delivery rollers 52 and 54. Then, step n-6 sets in, and the lamp LP is turned off to show the operator that copying action is in progress and a paper sheet for the next copying cycle cannot be fed. When the paper P is thus delivered and its leading end reaches the second paper detecting means S2, the second paper detecting means S2 sets in operation, and advance is made from step n-7 to step n-8 where the timer means T1 is set. The clutch means CL1 is energized until the time set by the timer means T1 elapses. When the time set by the timer T1 has expired advance is made from step n-9 to step n-10, and the clutch means CL1 is deenergized. The time from the setting of the timer means T1 to the time expires corresponds to the time during which the leading end of the paper P moves from the second paper detecting means S2 to the nipping portion of the conveyor rollers 56 and 58 which are not in motion. When the clutch means CL1 is deenergized, the rotation of the delivery rollers 52 and 54 is stopped, and the leading end of the paper P is kept nipped by the nipping portion of the conveyor rollers 56 and 58 as shown in FIG. 8-B (the paper is in a waiting condition).

When the paper is in a waiting condition as stated above, step n-11 sets in, and it is determined whether the second position detecting means PS2 is in action, or in other words, whether the document carrying mechanism 8 is located at a home position shown in FIG. 8-A (the position shown in FIGS. 1 and 2 also). When the document carrying mechanism 8 is not located at the home position, step n-12 sets in to hold the document carrying mechanism 8 at the home position. Specifically, the clutch means CL5 is energized to move the document carrying mechanism 8 to the position shown in FIG. 8-C in the direction shown by arrow 4 (FIG. 2). Then, the clutch means CL5 is deenergized and the clutch means CL6 is energized to move the document carrying mechanism 8 in the direction shown by arrow 6 (FIG. 2). When the second position detecting means PS2 detects the plate piece 272 provided in the document carrying mechanism 8, the clutch means CL6 is deenergized whereby the document carrying mechanism 8 is held in the home position. When the document carrying mechanism 8 is at the home position or it is held at the home position as stated above in step n-12, step n-13 sets in and the fan motor FM is energized to rotate the fan 76 cuunterclockwise in FIG. 2 and FIG. 8-B. Then, step n-14 sets in, and the clutch means CL6 is energized. When the clutch means CL6 is energized, the document carrying mechanism 8 is moved in the direction shown by arrow 6 (FIG. 8-A) via the clutch means CL6 by the action of the main motor M, and the document carrying mechanism 8 begins its scanning-exposure preparatory movement. This scanning-exposure preparatory movement is performed until the first position detecting means PSl detects the projecting piece 268 provided in one end portion of the document carrying mechanism 8, or in other words, until the document carrying mechanism 8 is held at a start-of-scan position shown in FIG. 8-B. When the document carrying mechanism 8 is held at the start-of-scan position, the action goes from step n-15 to step n-16 where the clutch means CL is deenergized and the movement of the document carrying mechanism 8 in the direction of arrow 6 is terminated (the scanning-exposure preparatory movement is over and the document carrying mechanism 8 is held at the position shown in FIG. 8-B).

When the scanning-exposure preparatory movement of the docueent carrying mechanism 8 is over, steps n-17 to n-22 are then performed successively. In ste n-17, the clutch means CL3 is energized. When the clutch means CL3 is energized, the roller 18 is drivingly connected to the main motor M via the clutch means CL3 and rotated clockwise in FIGS. 2 and 8-B, and the upper travelling portion 16*a* of the endless belt 16 is moved in the direction shown by arrow 22 (FIG. 8-B). In step n-18, the corona discharger 26 is energized. At this time, the switch means SW is in a first condition. Hence, a dc current is supplied to the corona discharger 26, and the corona discharger 26 applies a dc corona discharge to the discharge zone 32 to give an electric charge of a specified polarity to the surface of the photosensitive materaal present on the endless belt 16 (the corona discharger 26 acts for charging). Then, in step n-19, the electromagnetic solenoid 240 is energized. When the electromagnetic solenoid 240 is energized, the permanent magnet 46 of the magnetic brush mechanism 48 in the developing and cleaning device 40 is slightly rotated counterclockwise in FIG. 8-A from its second angular position shown in FIG. 8-A and held at its first angular position shown in FIGS. 8-B and 2. As a result, the S pole is located in the developer drawing zone and the N pole is held at a position opposite to the zone 78. Hence, the developer is held by the magnetic brush mechanism 48 in the developer drawing zone, and the magnetic brush generated and held in the magnetic brush mechanism 48 acts on the surface of the photosensitive material on the endless belt 16 in the zone 78. Then, in step n-20, the lamp 28 is turned on. The light illuminated by the lamp 28 and reflected by the document carrying mechanism 8 is projected onto the surface of the photosensitive material in the illuminating zone 341 through the rod-like lense 36 as shown by the one-dot chain line in FIG. 8-B (at this time, the lamp 28 acts for illuminating the document). The light projected onto the surface of the photosensitive material is regulated by the slit opening 106 formed in the guide portion 104 which is provided integrally with the frame 102 of the corona discharger 26. In step n-21, the clutch means CL5 is energized whereby the document carrying mechanism 8 is moved in the direction of arrow 4 (FIG. 8-B) via the clutch means CL5 by the action of the main motor M, and the document carrying mechanism 8 begins to make a scanning-exposure movement. The movement of the document carrying mechanism 8 in the direction of arrow 4 is continued until the first position detecting means PS1 detects the projecting piece 270 provided in the other end portion of the document carrying mechanism 8, or in other words, until it is moved from the start-of-scan position shown in FIG. 8-B and via the end-of-scan position, held at the charge eliminating position shown in FIG. 8-C. When the document carrying mechanism 8 is held at the charge eliminating position, advance is made from step n-22 to step n-23 where the clutch means CL5 is deenergized and the movement of the document carrying mechanism 8 in the direction of arrow 4 is over.

In the illustrated embodiment, the document 10 carried on the document carrying mechanism 8 is scanned and exposed during the period of the movement of the document carrying mechanism 8 from its start-of-scan position to its end-of-scan position (not shown). While the document carrying mechanism 8 moves from the end-of-scan position to the charge eliminating position, charge elimination gets ready. When it is held at the charge eliminating position, the lamp 28 illuminates the white surface of the tape 154 bonded to the document carrying mechanism 8 as shown in FIG. 8-C. During the scanning exposure movement of the document carrying mechanism 8, the reflected light from the document 10 is projected in the illuminating zone 34 onto the surface of the photosensitive material, to which an electric charge has been given in the discharge zone 32, and when the document carrying mechanism 8 is moved to the charge eliminating position, a latent electrostatic image corresponding to the document 10 is formed on the surface of the photosensitive material on the endless belt 16. In the illustrated embodiment, the clutch means CL3 is energized and the roller 18 acts as a driving roller during the scanning exposure, the upper travelling portion 16*a* of the endless belt becomes taut and becauee of this, a latent electrostatic image accurately corresponding to the document 10 is formed on the photosensitive material.

When the document carrying mechanism 8 is held at the charge eliminating position and the electrostatic latent image is formed, step n-24 to n-27 are successively carried out. In step 24, the corona discharger 26 is deenergized. In step n-25, the lamp 28 is turned off. In step n-26, the timer means T2 is set. When the time set by the timer means T2 is up, the action goes from step n-27 to step n-28 where the clutch means CL3 is deenergized. Thereafter, in step n-29, the electromagnetic solenoid 240 is deenergized. The time which elapses from the setting of the timer means T2 until the time-up corresponds to the period of time which elapses from the positioning of the document carrying mechanism 8 at the charge eliminating position until the latent electrostatic image formed on the surface of the photosensitive material during the scanning-exposure movement of the document carrying mechanism 8 is completely developed by the action of the developing and cleaning device 40. Accordingly, when the time set by the timer means T2 is up, the endless belt 16 assumes the states shown in FIG. 8-C (an area shown by the one-dot chain line on the peripheral surface of the endless belt 16 in FIGS. 8-C to 8-F indicates an area where toner particles exist). When the clutch means CL3 is deenergized after the time-up of the timer means T2, the above-mentioned movement of the endless belt 16 is stopped. When the electromagnetic solenoid 240 is deenergized, the permanent magnet 46 of the magnttic brush mechanism 48 of the developing and cleaning device 40 is brought to its second angular position shown in FIGS. 8-C and 8-A from its first angular position shown in FIG. 8-B. When the permanent magnet 46 is held at the second angular position, the S pole is deviated slightly clockwise from the developer drawing zone and the N pole is deviated slightly clockwise from the position opposite to the zone 78. As a result, no fresh developer is substantially held in the magnetic brush mechanism 48 in the developer drawing zone, nor does the magnetic brush formed by the magnetic brush mechanism 48 act substantially on the surface of the photosensitive material located on the endless belt 16. Thus, the development of the latent electrostatic image formed on the photosensitive material is terminated to form a toner image corresponding to the document 10 on the photosensitive material.

When the development to the toner image is over, step n-30 sets in to energize the clutch means CL4. When the clutch means CL4 is energized, the roller 20 is drivingly connected to the main motor M via the clutch means CL4 and rotated counterclockwise in FIGS. 2, 8-C and 8-D. The upper travelling portion 16*a* of the endless belt 16 is moved in the direction of arrow 24 (FIGS. 2, 8-C and 8-D). Then, step n-31 sets in, and the timer means T3 is set. When the time set by the timer means T3 is up, step n-33 sets in following step n-32, and the corona discharger 26 is energized. Furthermore, step n-34 sets in, and the clutch means CL2 is energized. Upon energization of the corona discharger 26, a dc current is supplied to the corona discharger 26 because the switch means SW is in the first condition. Thus, the corona discharger 26 applies a dc corona dischage to the discharge zone 32. When the clutch means CL2 is energized, the conveyor rollers 56 and 58 are rotated via the clutch means CL2, conveying of the copying paper P at stoppage is resumed, and the paper P is conveyed further downstream through the illuminating zone 34 and the discharge zone 32 as shown in FIG. 8-D. Therefore, in the discharge zone 32, a corona discharge is applied by the corona discharger 26 (which acts for transfer of the toner image) to the back surface (that surface which faces upwardly in FIG. 8-D) of the paper P, and the toner image formed on the surface of the photosensitive material disposed on the endless belt 16 is transferred to the paper P. During transfer, the front end, in the direction shown by arrow 24, of the toner image on the surface of the photosensitive material disposed on the upper travelling portion 16*a* of the endless belt 16 should be brought into alignment with the leading end of the paper P conveyed through the paper conveying passage 50 in the discharge zone 32. Accordingly, the time from the setting of the timer means T3 until its expiration time corresponds to the period of time from the starting of movement of the upper travelling portion 16*a* of the endless belt 16 until the front end, in the direction of arrow 24, of the toner image existing on the surface of the photosensitive material in the upper travelling portion 16a moves to a predetermined position (which is away from the discharge zone 32 by a distance equal to the distance from the nipping portion of the conveyor rollers 56 and 58 to the discharge zone 32). In the illustrated embodiment, during the scanning exposure (image formation), the upper travelling portion 16a of the endless belt 16 is moved in a predetermined direction shown by arrow 22, and in synchronism with the movement of the upper travelling portion 16a, the document carrying mechanism 8 is moved in the direction of arrow 4, and the document 10 to be copied is moved from its front end to its rear end. During image transfer, the toner imgge formed on the surface of the photosensitive material of the endless belt 16 is transferred to the copying paper from its front end, in the direction of arrow 24, to its rear end. Accordingly, by placing the document 10 on the document carrying mechanism 8 with its rear end as a reference, the toner image formed on the surface of the photosensitive material is transferred during image transfer from its end corresponding to the rear end of the document 10 toward its front end with its rear end as a reference. Thus, when the document carrying mechanism 8 is of the type which is moved always by a predetermined amount irrespective of the size of the document 10 during scanning exposure, especially of its length in the scanning-exposure direction, controlling the timing of starting the sending of copying paper at the time of image transfer can be maintained constant irrespective of the size of the document 10 to be copied, and the control operation can therefore be much simplified. Furthermore, in the illustrated embodiment, the clutch means CL4 is energized and the roller 20 acts as a driving roller during the transfer. Hence, in this case, too, the upper travelling portion 16a of the endless belt 16 becomes taut, and consequently, the toner image formed on the photosensitive material is transferred to the copying paper as is required. Furthermore, in the specific embodiment illustrated, the electromagnetic solenoid 240 is deenergized and the permanent magnet 46 of the developing and cleaning device 40 is held at the second angular position during the transfer. Hence, the magnetic brush formed by the magnetic brush mechanism 48 does not substantially act on the surface of the photosensitive material disposed on the endless belt 16, nor is the toner image formed on the surface of the photosensitive material disturbed by the magnetic brush during its movement through the zone 78.

The paper P to which the toner image has been transferred in the discharge zone 32 ss conveyed to the peeling zone 80 existing on the peripheral surface of the roller 20 by the action of the endless belt 16. In the peeling zone 80, the copying paper P tends to move further downstream by its own stiffness in the paper conveying passage 50, as can be understood from FIG. 8-D, whereas the endless belt 16 is moved downwardly along the peripheral surface of the roller 20. Consequently, the copying paper P kept in intimate contact with the upper travelling portion 16a of the endless belt 16 is peeled from the surface of the upper travelling portion 16a in the peeling zone 80, namely in the vicinity of the position at which the endless belt 16 moving in the direction of arrow 24 begins to make contact with the peripheral surface of the roller 20. The paper P is then conveyed toward the nipping position of the upper roller 62 and the lower roller 64 of the fixing device 60 as shown by the two-dot chain line in FIG. 8-D. During peeling of the copying paper P, the fan motor FM is energized to rotate the cooling fan 76 counterclockwise in FIGS. 2 and 8-D. Hence, within the housing 2 of the copying apparatus, the action of the cooling fan 76 generates an air stream directed through the space between the reflecting plate 100 and the linking fitting portion 96 of the main supporting structure 84, an air stream directed through the space between the linking fitting portion 96 of the main supporting structure 84 and the plate member 130 of the fixing unit 108, and an air stream directed through the space between the plate members 130 and 131 of the fixing unit 108. These air streams are discharged out of the housing 2 from the air discharge opening 134 formed in the left side of the fixing unit 108 through the space between the plate members 131 and 132 (see FIG. 2 also). Accordingly, the air stream which flows mainly between the linking fitting portion 96 and the plate member 130 is directed upwardly in the peeling area 80, and, during peeling this air stream acts on the upper surface (that surface which is opposite to the image-bearing surface) of the paper, which prior to peeling, is kept in intimate contact with the upper travelling portion 16a of the endless belt 16. This airstream thus aids in the peeling of the paper from the upper travelling portion 16a. Peeling of the paper is thereby made more accurate and surer.

When the conveying of the paper P is resumed and its trailing end leaves the second paper detecting means S2 (the second paper detecting means S2 is off), step n-36 sets in to deenergize the clutch means CL2. As a result, the driving connection between the conveyor roller 56 and the main motor M is cancelled, and the rotation of the conveyor rollers 56 and 58 is stopped. At this time, the trailing end of the copying paper P is nipped between the conveyor rollers 56 and 58, but its leading end portion is nipped between the upper roller 62 and the lower roller 64 of the fixing device 60. Hence, the paper P is conveyed further downstream mainly by the action of the upper roller 62 and the lower roller 64. When the clutch means CL2 is deenergized, step n-37 sets in, and the timer means T4 is set. When the time set by the timer means T4 is up, the action goes from step n-38 to step n-39 and then to step n-40. In step n-39, the clutch means CL4 is deenergized, and the movement of the upper travelling portion 16a of the endless belt 16 in the direction of arrow 24 is stopped. In step n-40, the corona discharger 26 is deenergized, and the transfer of the toner image formed on the surface of the photosensitive material disposed on the endless belt 16 to the copying paper P is finished.

In the illustrated embodiment, when the time set by the timer T4 has expired, the movement of the upper travelling portion 16a in the direction of arrow 24 stops. Hence, the time which elapses from the setting of the timer means T4 to the end of the set time corresponds to the period of time which elapses from the movement of the trailing end of the copying paper P leaves the second paper detecting means 52 until it is completely peeled from the surface of the endless belt 16.

When the transfer of the toner image and the peeling of the copying paper are over, steps n-41 to n-46 are then carried out successively. In step n-41, the switch means SW is changed over to the second condition from the first condition, and an ac current is supplied to the corona discharger 26. In step n-42, the clutch means CL3 is energized, whereupon the movement of the endless belt 16 is resumed and its upper travelling portion 16a is moved in the direction of arrow 22 shown in FIG. 8-E (also in FIG. 2). In step n-43, the corona discharger 26 is energized. Since at this time, the switch means SW is kept in the second condition, an ac current is supplied to the corona discharger 26, and the corona discharger 26 applies an ac corona discharge to the discharge zone 32. In step n-44, the lamp 28 is turned on. Since at this time, the document carrying mechanism 8 is held at the charge eliminating position shown in FIG. 8-E, the lamp 28 illuminates the surface of the white tape 154 in the document carrying mechanism 8 and the light reflected from the surface of the white tape 154 is projected onto the illuminating zone 34 through the rod-like lense 36. In step n-45, the electromagnetic solenoid 240 is energized. Thus, as stated hereinabove, the permanent magnet 46 is brought from the second angular position shown in FIG. 8-E and held at the first angular position shown in FIG. 8-F, and the magnetic brush formed by the magnetic brush mechanism 48 acts on the surface of the photosensitive material in the zone 78 as is required. In step n-46, the timer means T5 is set, and when the time set by the timer means T5 is up, advance is made from step n-47 to step n-48, and steps n-49 to n-52 are then successively carried out. Consequently, when the transfer of the toner image and the peeling of the copying paper are finished, the surface of the photosensitive material is cleaned. Specifically, in the discharge zone 32, an ac corona discharge is applied to the surface of the photosensitive material to erase the charge remaining on it (the corona discharger 26 acts for charge elimination). Then, the light reflected from the white tape 154 is illuminated on the surface of the photosensitive material in the illuminating zone 34 to ensure more accurate and certain erasure of the charge remaining on the surface of the photosensitive material (the lamp 28 acts for charge elimination). Thereafter, in the area 78, the magnetic brush of the magnetic brush mechanism 48 acts on the surface of the photosensitive material, and toner particles remaining on the surface of the photosensitive material are removed by the magnetic brush (the developing and cleaning device 40 acts for cleaning). In the illustrated embodiment, the remaining charge on the photosensitive material is erased by the action of the corona discharger 26 and the lamp 28 at the time of cleaning. Only one of the corona discharger 26 and the lamp 28 may be caused to act if it is sufficient for erasing the residual charge as is required. When the time set by the timer means T5 is up in step n-47, the cleaning is completely finished, and then step n-48 sets in. Since in the illustrated embodiment, the cleaning is over when the time set by the timer means T5 is up, the time from the setting of the timer means T5 to the time-up corresponds to the period of time from the starting of the movement of the upper travelling portion 16*a* of the endless belt 16 in the direction of arrow 22 to the complete cleaning of the surface of the photosensitive material. In the meantime, the copying paper to which the toner image has been transferred and which has been peeled from the surface of the photosensitive material passes through the paper conveying passage 50, and is discharged onto the paper receiver 74, during the cleaning of the photosensitive material as can be understood from FIGS. 8-E and 8-F.

When the cleaning of the photosensitive material is finished, the corona discharger 26 is deenergized in step n-48, and then in step n-49, the lamp 28 is turned off. In step n-50, the electromagnetic solenoid 240 is deenergized, and the permanent magnet 46 is brought to the second angular position from the first one. Furthermore, in step n-51, the clutch means CL3 is deenergized, and the movement of the endless belt 16 is stopped.

When the surface of the photosensitive material is completely cleaned, the clutch means CL6 is energized in the next step n-52. As a result, as mentioned hereinabove, the document carrying mechanism 8 is moved in the direction of arrow 6 (FIG. 8-F) via the clutch means CL6 by the action of the main motor M. When the documett carrying mechanism 8 is moved to the home position shown in FIG. 8-A, the second position detecting means PS2 detects the plate piece 272 provided in the document carrying mechanism 8 and sets in action. Hence, the movement of the document carrying mechanism 8 in the direction of arrow 6 is carried out until it reaches the home position. Upon arrival at the home position, the action goes from step n-53 to step n-54 where the clutch means CL6 is deenergized. As a result, the aforesaid movement of the document carrying mechanism 8 is stopped, and the document carrying mechanism 8 is held at the home position. Then, in step n-55, the fan motor FM is deenergized and the rotation of the cooling fan 76 is stopped. Subsequently, step 56 sets in and the main motor M is deenergized. Consequently, the rotation of the lower roller 64 of the fixing roller 60 and the discharge roller 66 is stopped, and the required copying operation comes to an end. When the copying operation is finished, the lamp LP is turned on in step n-3 to show the operator that another copying cycle is possible.

In the illustrated embodiment, the upper travelling portion 16*a* of the endless belt 16 is moved in the same direction (opposite to the moving direction during transfer) as the moving direction during image formation at the time of cleaning the photosensitive material. If desired, it may be moved in the opposite direction (the same direction as the moving direction during transfer). This, however, brings about the following inconvenience. When the upper travelling portion 16*a* is moved during the cleaning in the same direction as the moving direction during transfer, it is necessary to increase the amount of movement of the endless belt 16 during cleaning and the time required for cleaning becomes longer to make it difficult to perform copying at a high speed, as can be seen from FIGS. 8-E and 8-F. Furthermore, the magnetic brush formed by the magnetic brush mechanism 48 acts in opposite directions in developing the latent electrostatic image to a toner image and in removing the residual toner particles from the photosensitive material. It is difficult therefore to remove the residual toner particles fully from the photosensitive material.

In the illustrated electrostatic copying apparatus, the photosensitive material is moved in a predetermined direction during image formation, and in a direction opposite to the above predetermined direction during transfer of the toner image formed on the photosensitive material to the copying paper. Hence, the elements (corona discharger 26, lamp 28, etc.) used during image formation can be used commonly relatively easily during transfer and/or during cleaning. The structure of the apparatus as a whole can be simplified, and the apparatus as a whole can be made small-sized.

While the invention has been described above with reference to one specific embodiment of the electrostatic copying apparatus constructed in accordance with this invention, it should be understood that the invnntion is not limited to this specific embodiment, and various changes and modifications are possible without departing from the scope of the invention.

What we claim is:

1. An electrostatic copying apparatus comprising:

a photosensitive material-supporting means movable in a predetermined direction or a direction opposite thereto;

a photosensitive material disposed on at least a part of the surface of the photosensitive material-supporting means and having a length in said direction substantially equalling or exceeding a maximum copiable length;

an image-forming means for forming an image on the surface of the photosensitive material, the image-forming means including a corona discharger, disposed in a discharging zone, for uniformly charging the surface of the photosensitive material to a selected polarity during image formation and for applying corona discharge to the back of a copying paper sheet during image transfer whereby said corona discharger serves as a charging corona discharger and a transfer corona discharger;

means for conveying a copying paper sheet in said opposite direction through said discharging zone; and means for moving the photosensitive material-supporting means in said predetermined direction during formation of an image by the image-forming means on the surface of the photosensitive material and for moving the material-supporting means in said opposite direction during transfer of the image formed on the surface of the photosensitive material to a copying paper sheet.

2. The apparatus of claim 1, wherein the image-forming means further comprises a developing and cleaning device adapted to clean the surface of the photosensitive material, the moving means moving the photosensitive material-supporting means in said predetermined direction during cleaning of the surface of the photosensitive material after image transfer.

3. The apparatus of claim 1 wherein the photosensitive material-supporting means is comprised of an endless belt, and the photosensitive material is disposed on at least a part of the surface of the endless belt.

4. The apparatus of claim 1 wherein the image-forming means has a reciprocally movable document carrying mechanism, a lamp for illuminating a document to be copied placed on the document carrying mechanism, and an optical system for conducting light from the lamp to the surface of the photosensitive material; the document is placed on the document carrying mechanism with its rear end being as a reference; during image formation, scanning exposure is carried out from the front end toward the rear end of the document and at the time of image transfer, the image formed on the surface of the photosensitive material is transferred to the copying paper from the rear end toward the front end of the image with the rear end corresponding to the rear end of the document being as a reference.

5. The apparatus of claim 1 wherein the corona discharger serves to erase a charge remaining on the surface of the photosensitive material when the surface of the photosensitive material after the transfer is cleaned.

6. The apparatus of claim 1 wherein the developing and cleaning device acts as a developing device for developing a latent electrostatic image formed on the surface of the photosensitive material to a toner image during image formation, and as a cleaning device for removing toner particles remaining on the surface of the photosensitive material when the surface of the photosensitive material is cleaned after the transfer.

7. The apparatus of claim 6 wherein the developing and cleaning device includes a magnetic brush mechanism having a hollow sleeve adapted to be rotated in a predetermined direction and a magnet disposed within the hollow sleeve, and in relation to the magnetic brush mechanism, an actuating means is provided for selectively holding the magnet at a first position at which the magnetic brush formed by the magnet acts on the surface of the photosensitive material and a second position at which the magnetic brush does not substantially act on the surface of the photosensitive material, and said actuating means holds the magnet at said first position during image formation and during cleaning, and at said second position during image transfer.

8. The apparatus of claim 1 wherein the image-forming means includes a document carrying mechanism on which to place a document to be copied, a lamp and an optical system for conducting light from the lamp to the surface of the photosensitive material, and the lamp acts as a document illuminating lamp for illuminating the document placed on the document carrying mechanism during image formation, and as a charge eliminating lamp for erasing a residual charge remaining on the surface of the photosensitive material when the surface of the photosensitive material is cleaned after transfer.

9. The apparatus of claim 8 wherein the lamp and the optical system are fixed within the housing and the document carrying mechanism is disposed on the upper surface of the housing reciprocally in a predetermined direction, a portion having white characteristics is provided in a part of the under surface of the document carrying mechanism, and wherein during image formation, the document carrying mechanism is moved relative to the lamp and the optical system and the lamp illuminates the document placed on the document carrying mechanism, and during cleaning, the document carrying mechanism is held at a particular position and the lamp illuminates the portion having white characteristics provided in the document carrying mechanism which is at said particular position.

10. The apparatus of claim 1 wherein an illuminating zone and a discharge zone exist around the photosensitive material-supporting means; the image-forming means has a lamp, an optical system for conducting light from the lamp to the illuminating zone and a corona discharger disposed correspodingly to the discharge zone; and the copying paper to which the image formed on the surface of the photosensitive material is to be transferred is conveyed through the illumintting zone and the discharge zone.

11. The apparatus of claim 10 wherein the lamp acts as a document illuminating lamp for illuminating the document during image formation and as a charge eliminating lamp for erasing a residual charge remaining on the surface of the photosensitive material when the surface of the photosensitive material is cleaned after transfer; and the corona discharger serves to apply an electric charge of a specified polarity to the surface of the photosensitive material during image formation, to transfer the image formed on the surface of the photosensitive material to the copying paper during image transfer, and to erase the residual electric charge remaining on the surface of the phtosensitive material during cleaning.

12. The apparatus of claim 10 which further comprises a copying paper conveying passage for conducting the copying paper through the illuminating zone and the discharge zone, said conveying passage being defined by a guide member, said guide member having formed therein a slit opening for regulating light from the lamp which is projected onto the illuminating zone.

13. The apparaus of claim 12 wherein the guide member is provided integrally in a frame for the corona discharger.

14. An electrostatic copying apparatus comprising:

a housing, a photosensitive material-supporting means disposed within the housing and having a photosensitive material on its surface, an image forming means for forming an image on the surface of the photosensitive material, and a copying paper conveying means defining a copying paper conveying passage for conducting a copying paper to which the image formed on the surface of the photosensitive material is to be transferred, said image forming means including a developing device for developing the latent electrostatic image formed on the surface of the photosensitive material to a toner image; wherein (a) the developing device is mounted on a development unit frame, (b) the developing device and the development unit frame constitute a development unit, (c) a portion of the development unit defines a portion of the housing, (d) a paper feed table for conducting the copying paper to the upstream end of the paper conveying passage is provided in the development unit, (e) the developing device includes a development receptacle for holding a developer composed of carrier particles and toner particles, a developer applying means for holding part of the developer in the development receptacle and carrying it as is required, and a toner particle holding receptacle for holding toner particles to be supplied to the development receptacle, and (f) the paper feed table is mounted movably between a first position and a second position in relation to the toner particle holding receptacle, when it is at the first position, it covers a supply opening of the toner particle holding receptacle and when it is at the second position, it leaves open the supply opening of the toner particle holding receptacle.

15. The apparatus of claim 14 wherein the development unit is mounted detachably on one end of the housing upstream of the copying paper conveying passage.

16. An electrostatic copying apparatus comprising:

a supporting structure including a frame having a guide member integral therewith, the guide member having a slit opening therethrough and defining a copying paper passage;

a photosensitive material-supporting means having a phtosensitive material disposed on at least a part of its surface; and an image forming means for forming an image on the surface of the photosensitive material, said image forming means including a corona discharger, located in the frame, for applying an electric charge of a specified polarity to the surface of the photosensitive material, a lamp for illuminating a document to be copied, the slit opening through the guide member regulating light projected from the lamp onto the surface of the photosensitive material, and an optical system for conducting light from the lamp to the surface of the photosensitive material, the image forming means transferring the image formed on the surface of the photosensitive material to a copying paper conveyed through a copying paper conveying passage.

17. The apparatus of claim 16 wherein the optical system conducts the light from the lamp to an illuminating zone existing around the photosensitive material-supporting means; the corona discharger is disposed correspondingly to a discharge zone existing around the photosensitive material-supporting means; the copying paper to which the image formed on the surface of the photosensitive material is to be transferred is conveyed through the illuminating zone and the discharge zone; and the corona discharger serves to apply an electric charge of a specified polarity to the surface of the photosensitive material during formation of the image on the surface of the photosensitive material and to transfer the image formed on the surface of the photosensitive material to the copying paper during image transfer.

18. The apparatus of claim 17 wherein the corona discharger serves to erase a residual charge remaining on the surface of the photosensitive material during cleaning of the surface of the photosensitive material after image transfer, and the lamp acts as a document illuminating lamp for illuminating a document to be copied during image formation and as a charge eliminating lamp for erasing the residual electrical charge remaining on the surface of the photosensitive material during cleaning.

19. An electrostatic copying apparatus comprising:

a housing;

a photosensitive material-supporting means disposed within the housing and having a photosensitive material on its surface;

an image forming means for forming an image on the surface of the photosensitive material; and a copying paper conveying means defining a copying paper conveying passage for conducting a copying paper to which the image formed on the surface of the photosensitive material is to be transferred, said image forming means including a developing device for developing a latent electrostatic image formed on the surface of the photosensitive material to a toner image; wherein (a) the developing device is mounted on a development unit frame, (b) the developing device and the development unit frame constitute a development unit, (c) a paper feed table for conducting the copying paper to the upstream end of the paper conveying passage is provided in the development unit, (d) the developing device includes a development receptacle for holding a developer composed of carrier particles and toner particles, a developer applying means for holding part of the developer in the development receptacle, and a toner particle holding receptacle for holding toner particles to be supplied to the development receptacle, and (e) the paper feed table is mounted movably between a first position and a second position in relation to the toner particle holding receptacle;

and when it is at the first position, it covers a supply opening of the toner particle holding receptacle, and when it is at the second position, it leaves open the supply opening of the toner particle holding receptacle.

20. The apparatus of claim 19, wherein the development unit is detachably mounted on one end of the housing upstream of the paper conveying passage.

21. An electrostatic copying apparatus comprising:

a main supporting structure;

a discharge supporting structure mounted on the main supporting structure;

a photosensitive material-supporting means detachably mountable in the main supporting structure and having a photosensitive material disposed on its surface, an image forming means, mounted in the main supporting structure, for forming an image on the surface of the photosensitive material;

a copying paper conveying means for conveying a copying paper to which the image formed on the surface of the photosensitive material is to be transferred, the copying paper conveying means having a greater portion thereof mounted on the main supporting structure and the remainder thereof mounted on the discharge supporting structure; and a copying paper receiver provided integrally with the discharge supporting structure for receiving the copying paper conveyed by the action of the paper conveying means;

the discharge supporting structure and the main supporting structure defining at least a part of a housing framing the apparatus, the discharge supporting structure being mounted on the main supporting structure movably between an open position and a closed position, when the discharge supporting structure is at the open position, the downstream portion of a copying paper passage defined by the copying paper conveying means is opened, and when the discharge supporting structure is at the closed position, the copying paper is conveyed through the paper conveying passage and received by the paper receiver, the main supporting structure and the discharge support structure having annexed thereto a locking mechanism for releasably holding the discharge supporting structure at the closed position, the discharge supporting structure and the paper receiver being formed as a one-piece unit from a synthetic resin.

22. The apparatus of claim 21 wherein the base portion of the paper receiver has flexibility.

23. The apparatus of claim 22 wherein the base portion of the paper receiver becomes progressively narrow in a wedge shape from its front end to its base.

24. The apparatus of claim 22 wherein the discharge supporting structure has provided therein a stop piece which holds the paper receiver at a receiving position at which it receives the copying paper conveyed through the paper conveying passage.

* * * * *